US008065824B2

(12) United States Patent
Yamazaki et al.

(10) Patent No.: US 8,065,824 B2
(45) Date of Patent: Nov. 29, 2011

(54) SNOW REMOVING MACHINE

(75) Inventors: Nobuo Yamazaki, Wako (JP); Atsushi Moroi, Wako (JP); Toshiaki Kawakami, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/695,625

(22) Filed: Jan. 28, 2010

(65) Prior Publication Data

US 2010/0192422 A1 Aug. 5, 2010

(30) Foreign Application Priority Data

Jan. 30, 2009 (JP) ..... P2009-019633

(51) Int. Cl.
*E01H 5/09* (2006.01)

(52) U.S. Cl. ..... 37/257

(58) Field of Classification Search ..... 37/244, 37/246, 248, 251–257, 266, 242, 11.4, 348; 172/2–11; 180/656; 701/50; 192/34, 3.58, 192/56, 150

See application file for complete search history.

(56) References Cited

U.S. PATENT DOCUMENTS

| | | | | |
|---|---|---|---|---|
| 4,934,463 | A * | 6/1990 | Ishida et al. | 172/4.5 |
| 6,470,603 | B2 * | 10/2002 | Hanafusa et al. | 37/257 |
| 6,705,028 | B2 * | 3/2004 | Hanafusa et al. | 37/246 |
| 7,681,339 | B2 * | 3/2010 | Wakitani et al. | 37/348 |
| 2007/0022635 | A1 * | 2/2007 | Yamazaki et al. | 37/244 |

FOREIGN PATENT DOCUMENTS

JP 2004-278052 A 10/2004

* cited by examiner

*Primary Examiner* — Robert Pezzuto
(74) *Attorney, Agent, or Firm* — Arent Fox, LLP

(57) ABSTRACT

Snow removing machine includes an auger for removing accumulated snow, an accumulated snow height detection section for detecting a height of accumulated snow in front of the auger, an auger lifting and lowering section for lifting and lowering the auger, and a control section for controlling the auger lifting and lowering section to lift the auger in response to detection, by the accumulated snow height detection section, of the accumulated snow. By the provision of the accumulated snow height detection section, the present invention can save a human operator a trouble of setting in advance a target height position of the auger and thereby alleviate a load on the human operator.

5 Claims, 17 Drawing Sheets

SNOW REMOVING MACHINE

CROSS REFERENCE TO RELATED APPLICATION

This application claims the priority of Japanese Application No. P2009-019633, filed Jan. 30, 2009, the entire specification, claims and drawings of which are incorporated herewith by reference.

FIELD OF THE INVENTION

The present invention relates to snow removing machines which include an auger for removing accumulated snow and an auger lifting and lowering section for moving the auger in an up-down direction.

BACKGROUND OF THE INVENTION

Among various conventionally-known types of snow removing machines is one which includes a snow removing working section (auger) capable of being lifted (moved upward) and lowered (moved downward). In snow removing machines of such a type, left and right crawler-type traveling sections (hereinafter referred to as "crawler traveling sections") are provided on a traveling section frame, a machine frame is vertically pivotably mounted on the traveling section frame via a support pin, the machine frame and the traveling section frame are interconnected via a lifting and lowering cylinder, and the snow removing working section (auger) is provided on a front end portion of the machine frame. Thus, the height of the auger is adjustable by expansion/contraction operation of the lifting and lowering cylinder for causing the machine frame to vertically pivot about the support pin.

Also known today are snow removing machines which includes a control section for controlling the auger to take a target height position in order to facilitate auger height adjustment. By a user or human operator setting in advance a target height position of the auger, the control section compares a detected actual position of the auger against the target height position and controls the lifting and lowering cylinder to adjust the auger to the target height position. One example of such a snow removing machine is disclosed in Japanese Patent Application Laid-Open Publication No. 2004-278052.

However, with the snow removing machine disclosed in the 2004-278052 publication, there is a need for the human operator to set in advance a target height position of the auger, which would become a load on the human operator and thus impede enhancement of the operability of the machine.

SUMMARY OF THE INVENTION

In view of the foregoing prior art problems, it is an object of the present invention to provide an improved snow removing machine which can alleviate a load on a human operator and achieve an enhanced operability.

In order to accomplish the above-mentioned object, the present invention provides an improved snow removing machine, which comprises: an auger for removing accumulated snow; and an accumulated snow height detection section for detecting an accumulated snow height in front of the auger. According to the snow removing machine of the present invention thus arranged, the auger can be adjusted to an appropriate height corresponding to a height of accumulated snow detected by the accumulated snow height detection section. Namely, by the provision of the accumulated snow height detection section, the present invention can eliminate a need for a human operator to set (i.e., can save the human operator a trouble of setting) in advance a target height position of the auger and thereby alleviate a load on the human operator.

Preferably, the snow removing machine of the present invention further comprises: an auger lifting and lowering section for lifting and lowering the auger; and a control section for controlling the auger lifting and lowering section to lift the auger when an accumulated snow height has been detected by the accumulated snow height detection section. Thus, even when the accumulated snow height is higher than the auger, the auger can be automatically lifted by the control section controlling the auger lifting and lowering section in accordance with the accumulated snow height. In this way, the snow removing machine can always efficiently remove accumulated snow, and thus, the operability of the snow removing machine can be enhanced.

Preferably, when no accumulated snow height has been detected by the accumulated snow height detection section, the control section controls the auger lifting and lowering section to lower the auger.

Thus, according to the present invention, the auger is lifted when an accumulated snow height has been detected by the accumulated snow height detection section and lowered when no accumulated snow height has been detected by the accumulated snow height detection section. In this manner, the present invention allows the auger to move along the surface of the accumulated snow and thus allows the auger to perform snow removing along the surface of the accumulated snow. By thus performing snow removing along the surface of the accumulated snow, the present invention can even further enhance the operability of the snow removing machine.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

In the following description, the terms "front", "rear", "left" and "right", etc. are used to refer to directions as viewed from a user or human operator operating a snow removing machine.

First Embodiment

Figure 1:
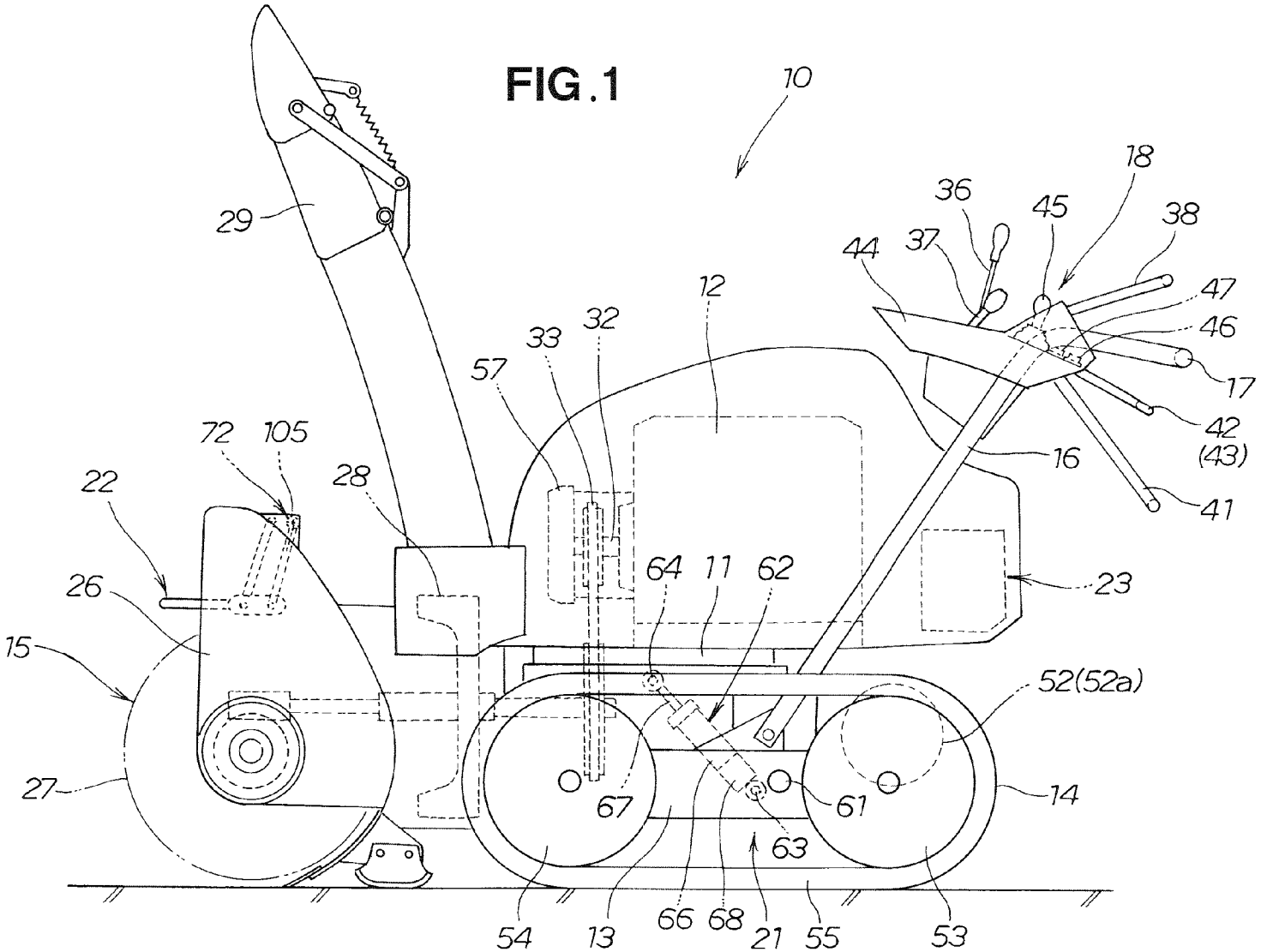
FIG. 1 is a view showing a first embodiment of a snow removing machine of the present invention.

FIG. 1 is a view showing a first embodiment of the snow removing machine 10 of the present invention. As shown, the first embodiment of the snow removing machine 10 includes: an engine 12 mounted on an upper portion of a machine frame 11; left and right crawler-type traveling sections (hereinafter referred to as "crawler traveling sections") 14 (only the left crawler traveling section 14 is shown in the figure) mounted to a lower portion of the machine frame 11 via a traveling section frame 13; a snow removing working section 15 mounted to a front portion of the machine frame 11; left and right handles 16 (only the left handle 16 is shown in the figure) mounted to a rear portion of the machine frame 11; grips (generally U-shaped grips) 17 fixed to upper end portions of corresponding ones of the left and right handles 16; and an operation section 18 provided in front of the grips 17.

The snow removing machine 10 further includes: an auger lifting and lowering section 21 for moving up and down an auger 27 of the snow removing working section 15; a snow height detection section 22 for detecting a height of accumulated snow in front of the auger 27; and a control section 23 for controlling lifting of the auger 27 on the basis of accumulated snow height detection information output from the detection section 22.

The snow removing working section 15 includes a housing 26 provided in front of the machine frame 11, the auger 27 and a blower 28 provided within the housing 26, and a shooter 29 projecting upward from an upper portion of the auger 27. The auger 27 and the blower 28 are connected to a drive shaft 32 of the engine 12 via an operating clutch 33. In the snow removing working section 15, accumulated snow in front of the auger 27 is gathered toward a central portion in the width direction of the body of the machine 10 through rotation of the auger 27 and blower 28 activated by the engine 12, and the thus-gathered snow is through up via the blower 28 away from the machine 10 through the shooter 29.

Cross member (not shown) spans between respective near-upper-end portions of the left and right handles 16, so that the left and right handles 16 has increased rigidity.

The operation section 18 includes: a forward/rearward travel speed lever 36 and throttle lever 37 provided on the cross member spanning between the left and right handles 16; a travel preparation lever 38 and rearward travel preventing lever 41 provided on the left and right handles 16; a left turning lever 42 provided on the left handle 16; a right turning lever 42 provided on the right handle 16; an operation section cover 44 covering mounted areas of these levers; an auger lifting and lowering lever 45 provided on the operation section cover 44; a main switch button 46; and a operating clutch button 47.

The left crawler traveling section 14 includes an electric motor unit 52 provided on a left rear end portion of the traveling section frame 13, a driving wheel 53 provided in the electric motor unit 52, a driven wheel 54 provided on a left front end portion of the traveling section frame 13, and a crawler belt wound at opposite ends on the driving wheel 53 and the driven wheel 54.

The electric motor unit 52 has a case 52*a* within which are provided an electric motor and a transmission. A charging power generator 57 is provided for supplying a voltage to the electric motor of the electric motor unit 52. The charging power generator 57 is connected via a pulley (not shown) to the drive shaft 32 of the engine 12.

The right crawler traveling section 14 is disposed and constructed in left-right horizontal symmetrical relation to the above-described left crawler traveling section 14, and elements of the right crawler traveling section 14 will be described as necessary using the same reference numerals as the elements of the left crawler traveling section 14.

As the left and right driving wheels 53 in the left and right crawler traveling section 14 are rotated in a forward direction by the left and right electric motor units 52, the left and right crawler belts 55 can be rotated in a forward direction to cause the snow removing machine 10 to travel forward (leftward in FIG. 1). On the other hand, as the left and right driving wheels 53 in the left and right crawler traveling section 14 are rotated in a reverse direction by the left and right electric motor units 52, the left and right crawler belts 55 can be rotated in a reverse direction to cause the snow removing machine 10 to travel rearward (rightward in FIG. 1).

The machine frame 11 is vertically pivotably supported on a rear end portion of the traveling section frame 13 via the pin 61, and an auger housing lifting and lowering mechanism 62 is connected at opposite ends to the traveling section frame 13 and machine frame 11. More specifically, the auger housing lifting and lowering mechanism 62 is connected at one end (cylinder end) to the traveling section frame 13 via a connecting pin 63 and connected at the other end (rod end) to the machine frame 11 via a connecting pin 64.

The auger housing lifting and lowering mechanism 62 is an actuator where a cylinder 66 has a telescopic (i.e., expandable/retractable) piston rod 67 and a lifting and lowering electric motor 68 is connected to the cylinder 66. The auger housing lifting and lowering mechanism 62 is an electric hydraulic cylinder where a hydraulic pump (not shown) is driven by the lifting and lowering electric motor 68 so that the piston rod 67 is expandable and contractable by oil supplied from the hydraulic pump.

By the expansion/contraction operation of the auger housing lifting and lowering mechanism 62, the machine frame 11 is vertically pivotable about the support pin 61. The auger 27 can be lifted or moved upward by the upward pivoting movement of the machine frame 11 about the support pin 61 effected by the expansion operation of the mechanism 62, and it can be lowered or moved downward by the downward pivoting movement of the machine frame 11 about the support pin 61 effected by the contraction operation of the mechanism 62.

Figure 2:
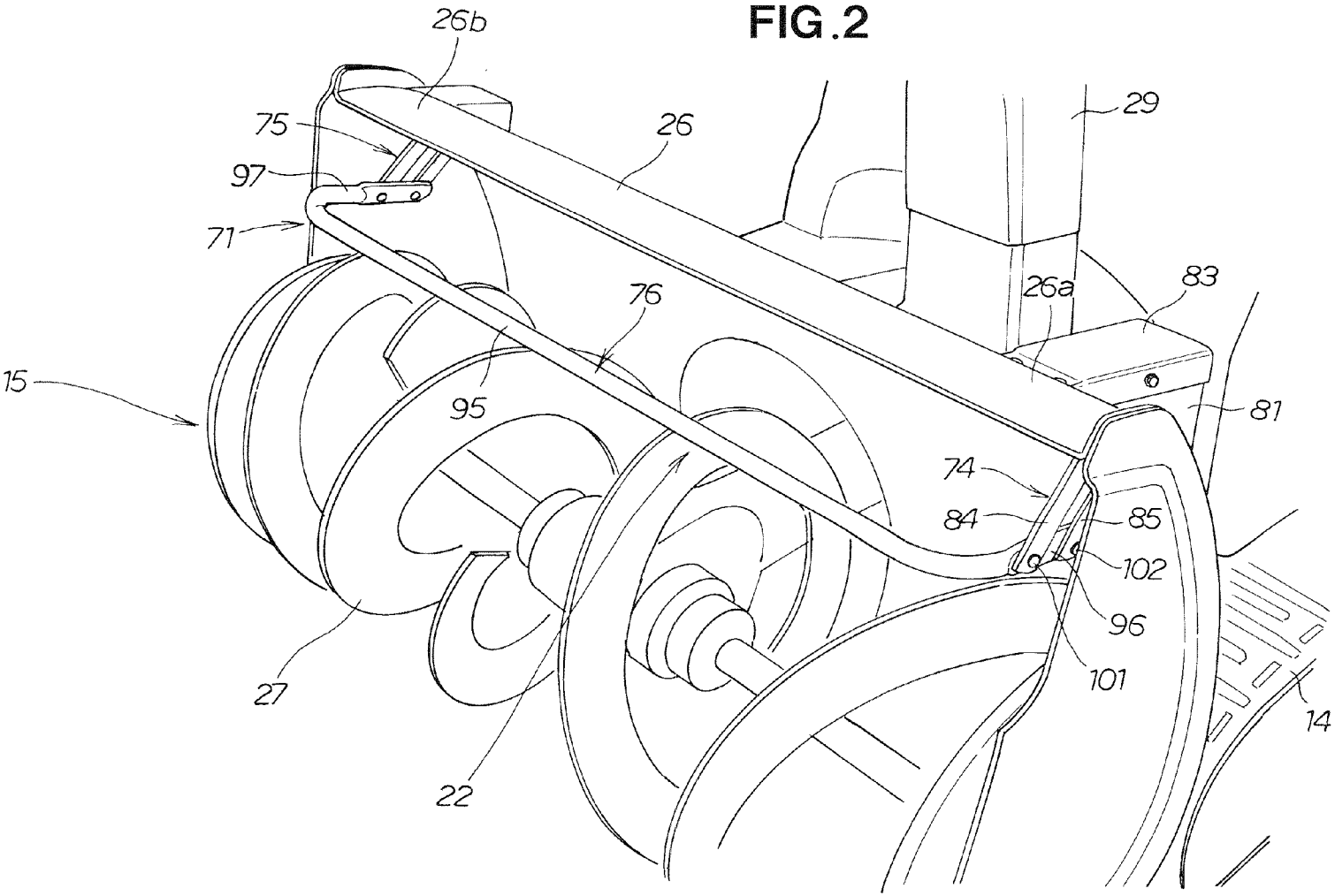
FIG. 2 is a perspective view showing a detection section employed in the first embodiment of the snow removing machine.
Figure 3:
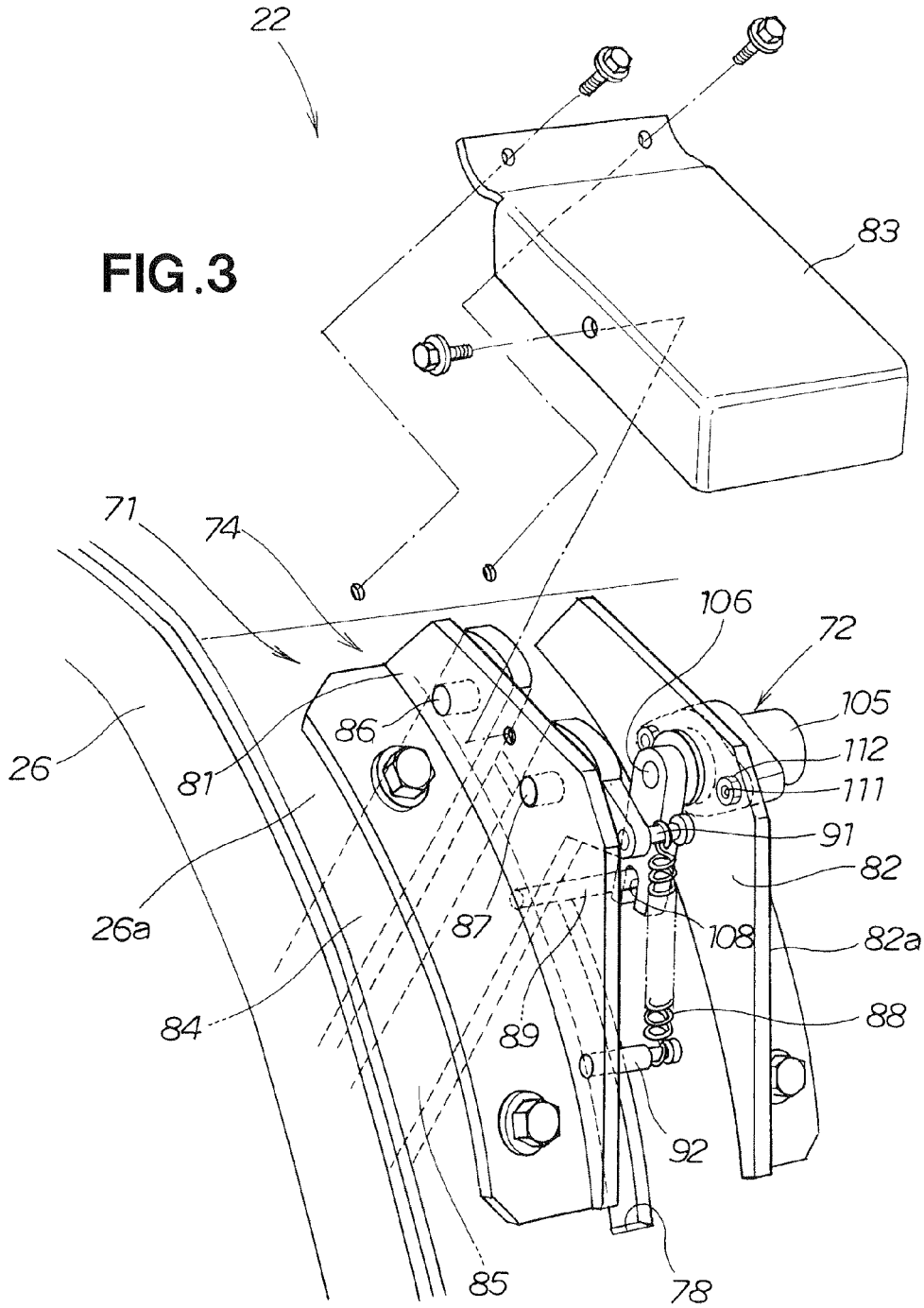
FIG. 3 is a perspective view showing a left support section and accumulated snow detection section of the detection section shown in FIG. 2.

As shown in FIGS. 2 and 3, the accumulated snow height detection section 22 includes a detection actuation section 71 movable toward the rear of the machine body by abutting against the accumulated snow, and an accumulated snow detection section 72 capable of detecting the actuation of the actuation section 71.

The actuation section 71 includes a left support portion 74 provided on a left end upper portion 26*a* of the housing 26, a right support portion 75 provided on a right end upper portion 26*b* of the housing 26, and a snow-contacting bar 76 connected to the left and right support portions 74 and 75.

Figure 4:
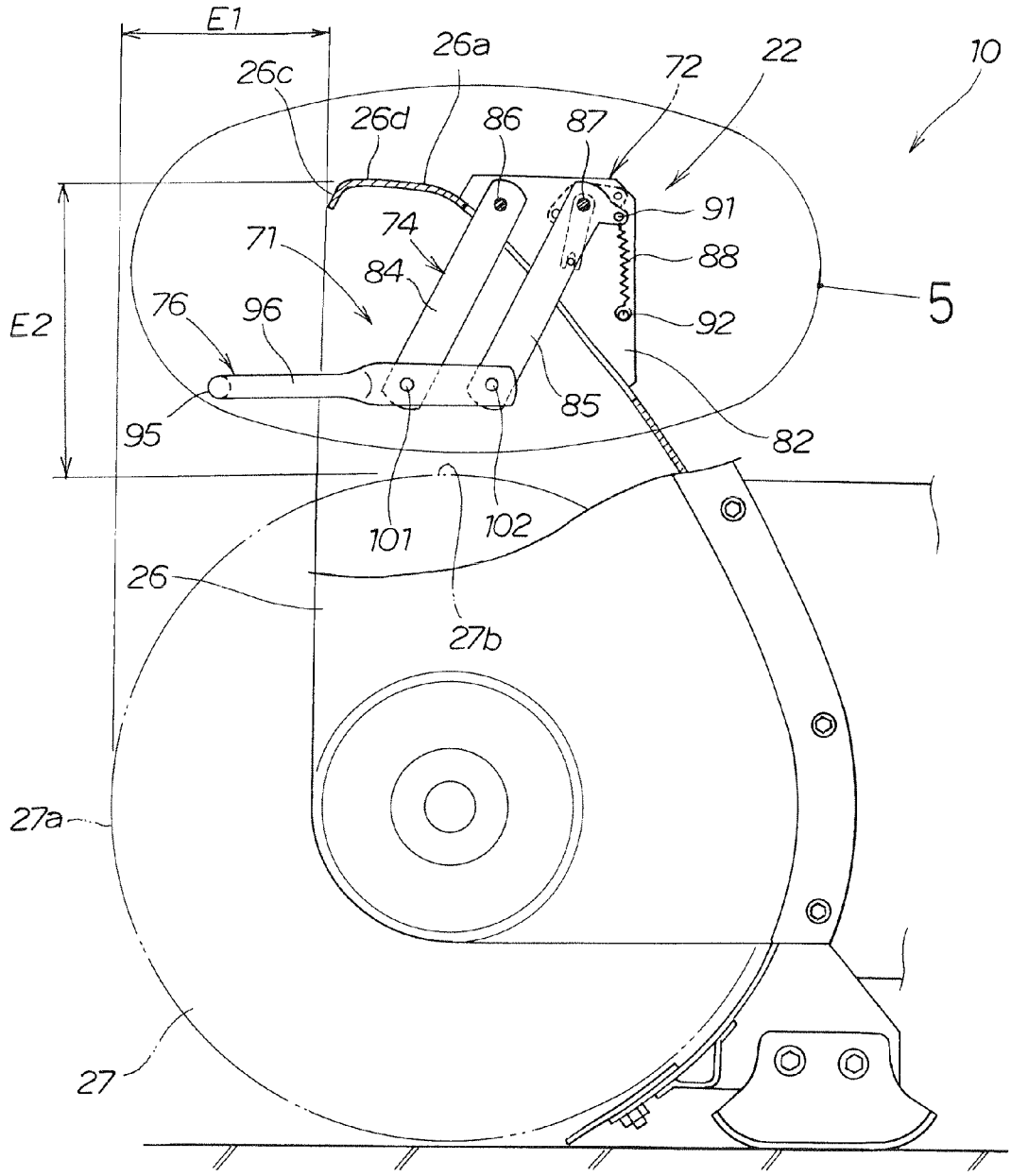
FIG. 4 is a side view showing the detection section employed in the first embodiment of the snow removing machine.
Figure 5:
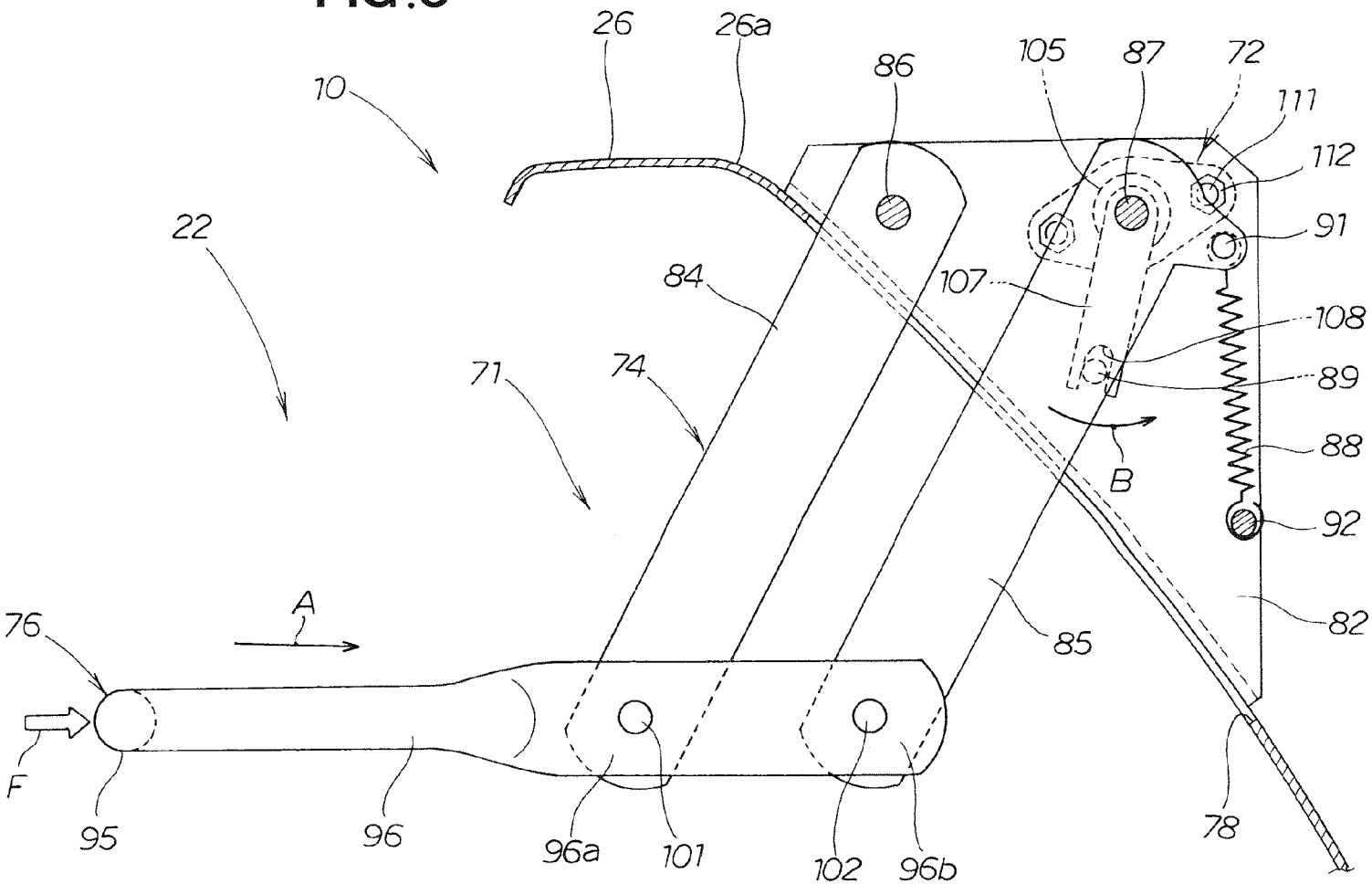
FIG. 5 is an enlarged view of a section encircled at 5 in FIG. 4.

As shown in FIG. 4 that is a side view of the detection section 22 and FIG. 5 that is an enlarged view of a section encircled at 5 in FIG. 4, the left support portion 74 includes: an outer mounting bracket 81 (see FIG. 3) fixed to the left end upper portion 26*a* of the housing 26; an inner mounting bracket 82 connected to the inner surface (closer to the longitudinal centerline of the machine body) of the outer mounting bracket 81; a cover 83 (see FIG. 3) provided on upper portions of the outer and inner mounting brackets 81 and 82; a front pivotable lever 84 pivotably connected to the outer mounting bracket 81 via an upper front connecting pin 86; a rear pivotable lever 85 pivotably connected to the outer mounting bracket 81 via an upper rear connecting pin 87; and a spring 88 normally biasing the rear pivotable lever 85.

As shown in FIG. 3, the outer mounting bracket 81 and the inner mounting bracket 82 extend parallel to each other on the left end upper portion 26*a* and are spaced from each other by a predetermined distance in the width direction of the machine body.

The front pivotable lever 84 is supported on the outer mounting bracket 81 via the upper front connecting pin 86 in such a manner that it is pivotable in the front-rear direction of the machine body, while the rear pivotable lever 85 is supported on the outer mounting bracket 81 via the upper rear connecting pin 87 in such a manner that it is pivotable in the front-rear direction of the machine body. The front and rear pivotable levers 84 and 85 project into the housing 26 through a guide hole 78 formed in the housing 26.

The spring 88 is fixed at opposite ends to a support pin 91 provided on an upper end portion of the rear pivotable lever 85 and a lower support pin 92 provided on a lower end portion of the outer mounting bracket 81. By the biasing force of the spring 88, the rear pivotable lever 85 is normally biased to pivot about the upper rear connecting pin 87 in a forward direction or clockwise direction of FIG. 4.

As shown in FIG. 2, the snow-contacting bar 76 includes a snow-contacting section 95 extending generally in parallel to an upper wall portion of the housing 26, a left connecting portion 96 bent rearward from a left end portion of the snow-contacting section 95, and a right connecting portion 97 bent rearward from a right end portion of the snow-contacting section 95. The snow-contacting bar 76 has a generally U shape defined by the snow-contacting section 95, left connecting portion 96 and right connecting portion 97.

In the snow-contacting bar 76, as shown in FIG. 5, the left connecting portion 96 is pivotably connected at its generally middle portion 96*a* to a lower end portion of the front pivotable lever 84 by means of a lower front connecting pin 101 and pivotably connected at a rear end portion 96*b* to a lower end portion of the rear pivotable lever 85 by means of a lower rear connecting pin 102. In this state, the front pivotable lever 84 and the rear pivotable lever 85 extend in parallel to each other, and the snow-contacting bar 76 is disposed in a horizontal orientation.

The right connecting portion 97 of the snow-contacting bar 76, as shown in FIG. 2, is connected to the right support portion 75 in the same manner as the left connecting portion 96 is connected to the left support portion 74.

The right support portion 75 is constructed in left-right horizontal symmetrical relation to the above-described left support portion 74, and elements of the right support portion 75 will be described as necessary using the same reference numerals as the elements of the left support section 74.

The detection actuation section 71 is normally biased by the springs 88 in the clockwise direction such that the front and rear pivotable levers 84 and 85 slant downwardly toward the front of the machine body.

As shown in FIG. 4, the snow-contacting section 95 of the snow-contacting bar 76 is located in a horizontal area E1 between the front end 27*a* of the auger 27 and the front end 26*c* of the housing 26. Thus, when the auger 27 has had its front end 27*a* cut into accumulated snow (i.e., at the beginning of snow removing work), the snow-contacting section 95 abuts against the accumulated snow. Thus, the auger 27 can perform the snow removing work while being lifted. In this way, the instant embodiment can enhance the operability of the snow removing machine 10.

Further, the snow-contacting section 95 of the snow-contacting bar 76 is located in a vertical area E2 between the upper end 27*b* of the auger 27 and the upper end 26*d* of the housing 26. Thus, the auger 27 can be located near the upper end of the auger 27. Therefore, when the accumulated snow is higher than the upper end 27*b* of the auger 27, the auger 27 can be lifted reliably. In this way, the instant embodiment allows the height of the auger 27 to be optimally selected, and thereby enhance the operability of the snow removing machine 10.

Figure 6:
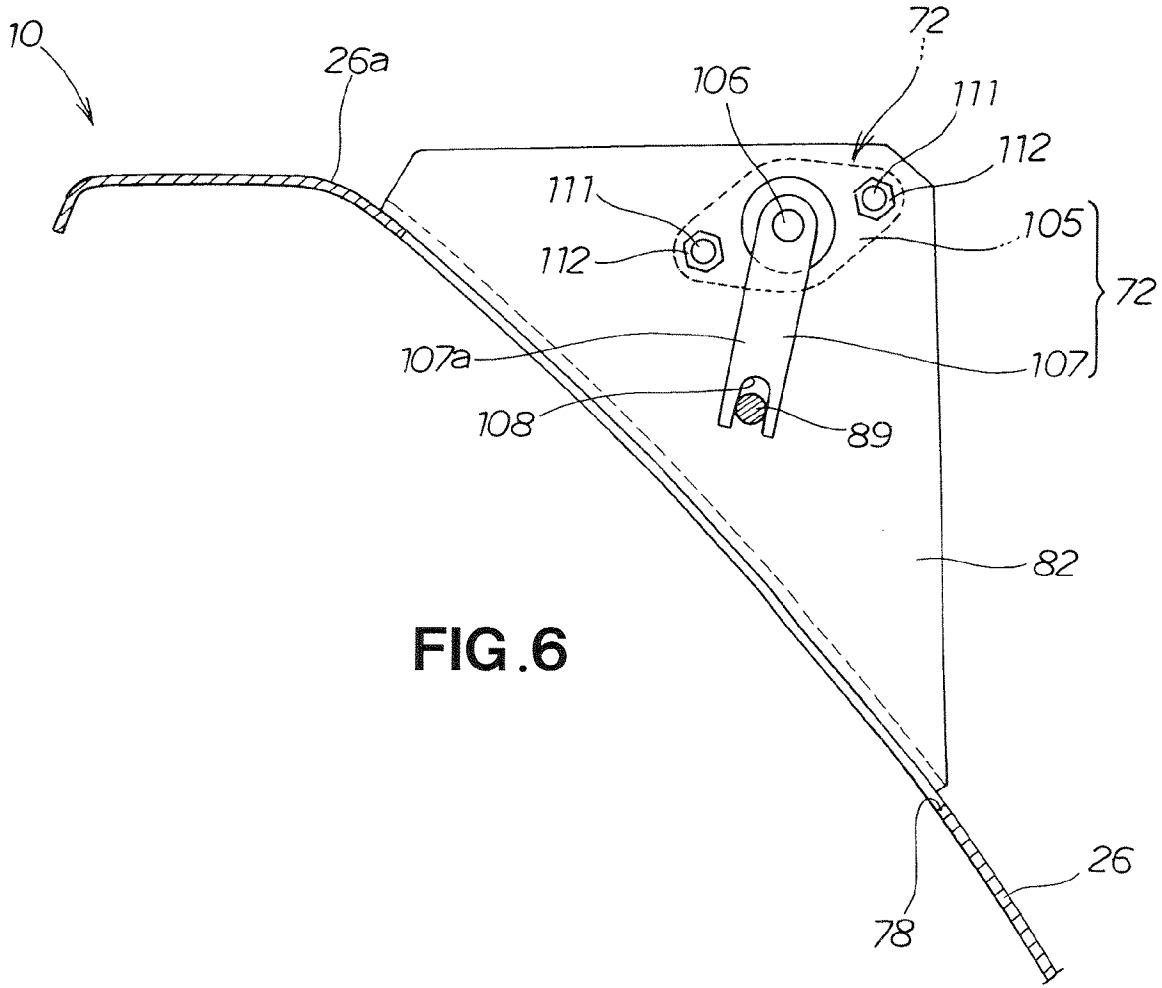
FIG. 6 is a side view showing the accumulated snow detection section shown in FIG. 2.

As shown in FIGS. 5 and 6, the accumulated snow detection section 72 includes an accumulated snow height detecting sensor (e.g., variable resistance type potentiometer) 105, and an operating lever 107 connected to an actuating shaft 106 of the accumulated snow height detecting sensor 105.

As shown in FIG. 3, the accumulated snow height detecting sensor 105 is fixed to the inner surface 82*a* of the inner mounting bracket 82 closer the longitudinal centerline of the machine body by means of bolts 111 and nuts 112 (see FIG. 6), and the actuating shaft 106 is disposed coaxially with the upper rear connecting pin 87. The operating lever 107 has an inserting recessed portion 108 formed in a lower end portion (distal end portion) 107*a* thereof, and an actuating pin 89 is inserted in the inserting recessed portion 108.

The actuating pin 89 is provided on the rear pivotable lever 85. Thus, as the rear pivotable lever 85 pivots in the front-rear direction of the machine body about the upper rear connecting pin 87, the actuating pin 89 arcuately moves about the upper rear connecting pin 87. By the actuating pin 89 arcuately moving about the upper rear connecting pin 87 like this, the operating lever 107 pivots in the front-rear direction of the machine body about the actuating shaft 106. Thus, the actuating shaft 106 pivots clockwise or counterclockwise with the operating lever 107, in response to which the resistance of the accumulated snow height detecting sensor 105 varies.

Figure 7:
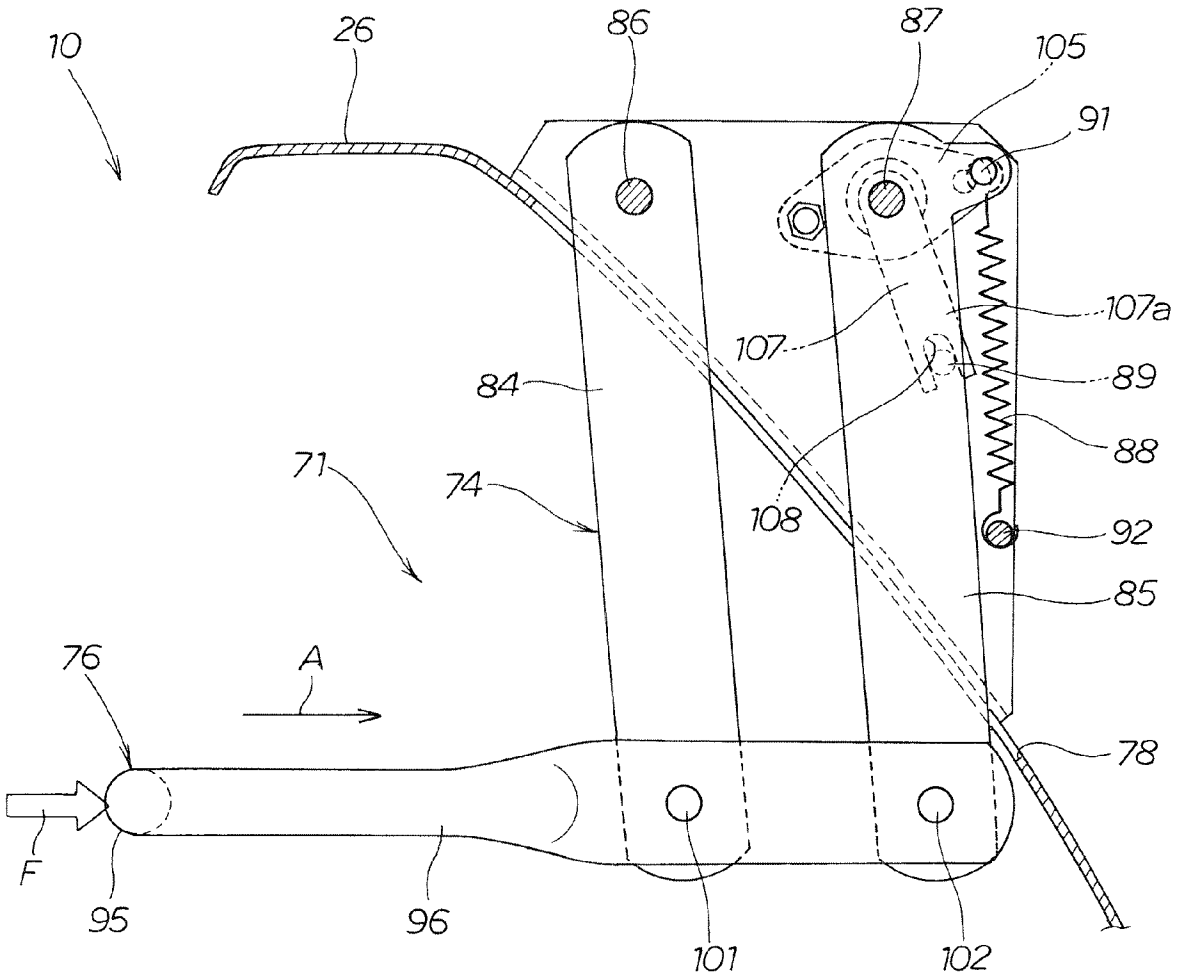
FIG. 7 is a side view showing a snow contacting bar having abutted against accumulated snow to be pressed toward the rear of a machine body.

As the snow removing machine 10 travels forward, the snow-contacting section 95 abuts against accumulated snow, so that a load F acts on the snow-contacting section 95, as shown in FIG. 7. By the load F acting on the snow-contacting section 95, the snow-contacting section 95 is pressed rearwardly, i.e. into the housing 25.

Thus, the front pivotable lever 84 pivots counterclockwise toward the rear of the machine body about the upper front connecting pin 86, and simultaneously, the rear pivotable lever 85 pivots counterclockwise toward the rear of the machine body about the upper rear connecting pin 87. By the rear pivotable lever 85 pivoting counterclockwise toward the rear of the machine body, the actuating pin 89 arcuately moves about the upper rear connecting pin 87 toward the rear of the machine body, as indicated by an arrow B of FIG. 5.

By the actuating pin 89 moving toward the rear of the machine body, the operating lever 107 pivots toward the rear of the machine body about the shaft 106 (FIG. 6), as indicated by an arrow B.

Thus, the actuating shaft 106 pivots in the counterclockwise direction (i.e., direction of the arrow B), in response to which the voltage of the accumulated snow height detecting sensor 105 (i.e., accumulated snow height detection information) varies so that a current accumulated snow height in front of the auger 27 can be detected. The voltage (accumulated snow height detection information) of the detecting sensor 105 is delivered to the control section 23.

As shown in FIG. 1, the control section 23 is provided on a rear end portion of the machine frame 11. The following describe functions of the control section 23 on the basis of a functional block diagram of FIG. 8.

The control section 23 determines whether the main switch button 46 is currently ON or OFF. The control section 23 also determines, on the basis of "auger lifting/lowering information" sent from a lifting and lowering lever detecting sensor operatively connected to the auger lifting and lowering lever 45, whether the auger 27 is currently being lifted/lowered through operation by the human operator or not currently being lifted/lowered (i.e., currently being in a stopped state).

When the auger 27 is not currently being lifted/lofted (i.e., currently in the stopped state), the control section 23 also compares a value of "voltage (accumulated snow height information)", sent from the detecting sensor 105, against a preset threshold value. If the value of the accumulated snow height information is greater than the threshold value (i.e., if the current detected snow height is greater than a height indicated by the threshold value), the control section 23 determines that the snow contacting section 95 has contacted accumulated snow.

If the control section 23 determines that the snow contacting section 95 has contacted accumulated snow (i.e. that a height of the accumulated snow (accumulated snow height) in front of the auger 27 has been detected by the accumulated snow height detection section 22), the control section 23 controls the auger lifting and lowering section 21 to lift the auger 27.

Thus, on the basis of the accumulated snow height detection information output from the accumulated snow height detecting sensor 105, the control section 23 can adjust the auger 27 to an appropriate height corresponding to the current accumulated snow height.

By the provision of such an accumulated snow height detection section 22, the instant embodiment can eliminate a need for the human operator to set in advance a target height position of the auger 27 for adjustment of the height of the auger 27 and thus alleviate a burden or load on the human operator. By thus eliminating the time necessary for the human operator to set in advance a target height position of the auger 27, the instant embodiment can enhance the operability of the snow removing machine.

If, on the other hand, the value of the accumulated snow height information is not greater than the threshold value, the control section 23 determines that the snow contacting section 95 has not yet contacted accumulated snow.

Figure 8:
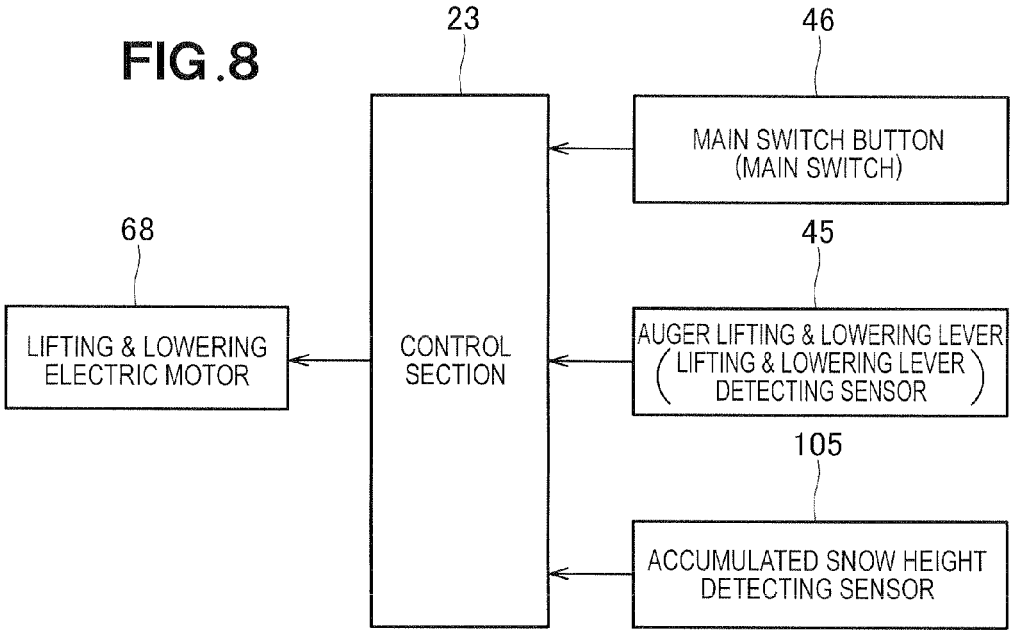
FIG. 8 is a functional block diagram of the first embodiment of the snow removing machine.
Figure 9:
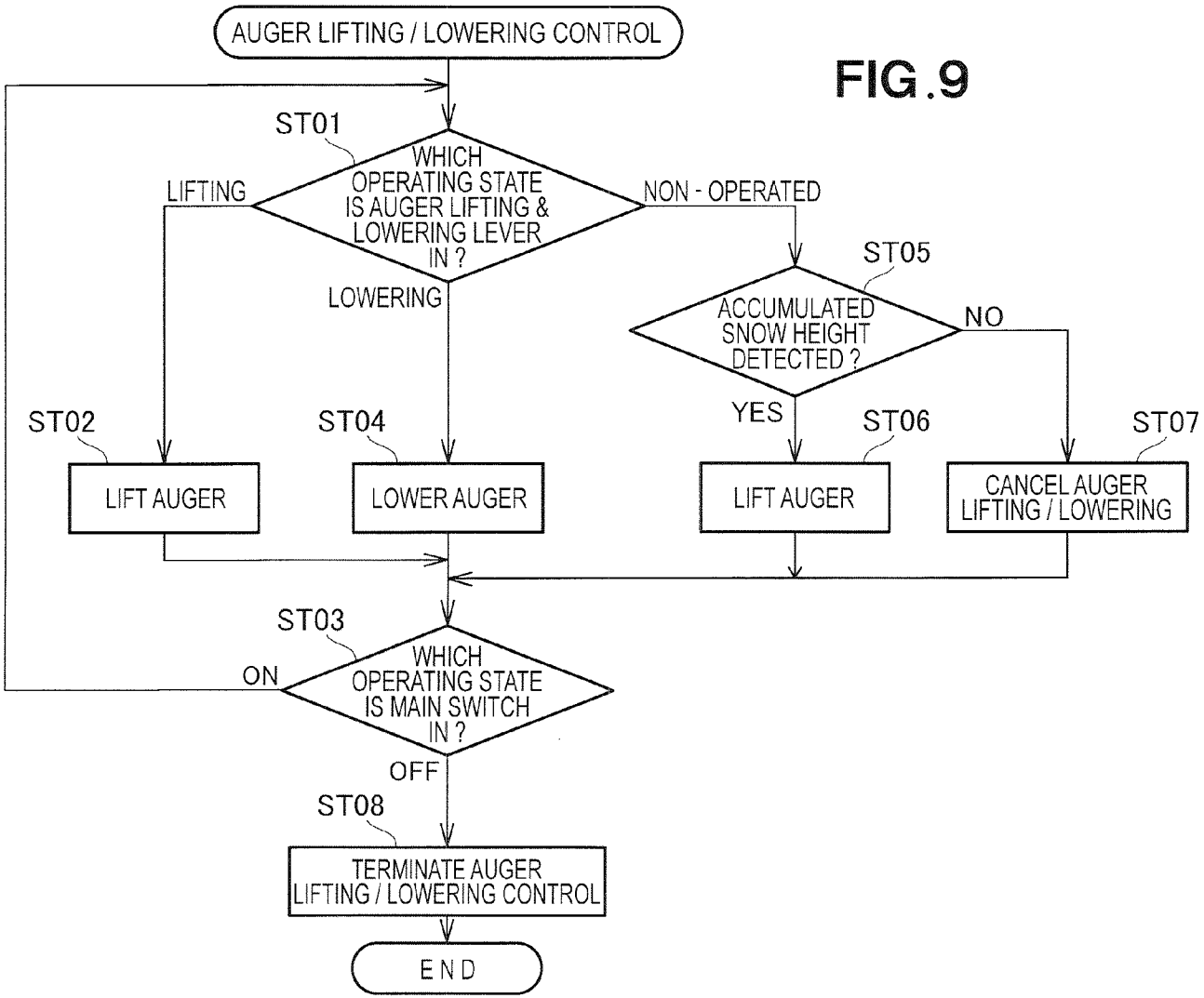
FIG. 9 is a flow chart showing an example operational sequence executed by a control section to lift an auger in the first embodiment of the snow removing machine.

Next, a description will be given about an example operational sequence executed by the control section 23 to control the auger 27, with reference to a flow chart of FIG. 9 in conjunction with the functional block diagram of FIG. 8.

At step ST01, the control section 23 determines whether the auger lifting and lowering lever 45 is currently in an operated state (i.e., auger-lifting position or auger-lowering position), or in a non-operated (or stopped) state. Namely, on the basis of "auger lifting/lowering information" output from the lifting and lowering lever detecting sensor operatively connected to the auger lifting and lowering lever 45, the control section 23 determines whether the auger lifting and lowering lever 45 is currently being operated by the human operator to lift or lower the auger 27 or not currently being operated by the human operator to lift or lower the auger 27.

If the auger lifting and lowering lever 45 is currently in the auger-lifting position (i.e., the auger 27 is currently being lifted) as determined at step ST01, the control section 23 control goes to step ST02 in order to continue the lifting of the auger 27. Then, the ON/OFF state of a main switch is checked, and if the main switch is ON as determined at step ST03, the control section 23 reverts to step ST01. Note that the main switch is switched between ON and OFF states through operation, by the human operator, of the main switch button 46.

If, on the other hand, the auger lifting and lowering lever 45 is currently in the auger-lowering position) (i.e., the auger 27 is currently being lowered) as determined at step ST01, the control section 23 goes to step ST04 in order to continue the lowering of the auger 27. Then, if the main switch is ON as determined at step ST03, the control section 23 reverts to step ST01.

Further, if the auger lifting and lowering lever 45 is currently in the non-operated state, the control section 23 control branches to step ST05, where the control section 23 further determines, on the basis of the accumulated snow height detection information output from the accumulated snow height detecting sensor 105, whether the value of the accumulated snow height information is greater than the threshold value. If the value of the accumulated snow height information is greater than the threshold value as determined at step ST05, the control section 23 continues to step ST06.

At step ST06, the control section 23 sends an auger lifting signal to the lifting and lowering electric motor 68 of the auger housing lifting and lowering mechanism 62, in response to which the lifting and lowering electric motor 68 is driven so that the piston rod 67 of the auger housing lifting and lowering mechanism 62 is expanded to lift the auger 27. If the main switch is ON as determined at step ST03, the control section 23 reverts to step ST01.

If the value of the accumulated snow height information is not greater than the threshold value (i.e., if the current detected snow height is not greater than the height indicated by the threshold value), the control section 23 continues to step ST07, where the control section 23 sends an auger lifting/lowering cancellation signal to the lifting and lowering electric motor 68. Thus, the lifting and lowering electric motor 68 is deactivated to stop and retain the piston rod 67 of the auger housing lifting and lowering mechanism 62 at a current position, so that the lifting/lowering of the auger 27 is terminated.

If the main switch is ON as determined at step ST03 following step ST07, the control section 23 reverts to step ST01.

If, on the other hand, the main switch is OFF as determined at step ST03, the control section 23 proceeds to step ST08, where the lifting/lowering control of the auger 27 by the control section 23 is terminated.

Figure 10A:
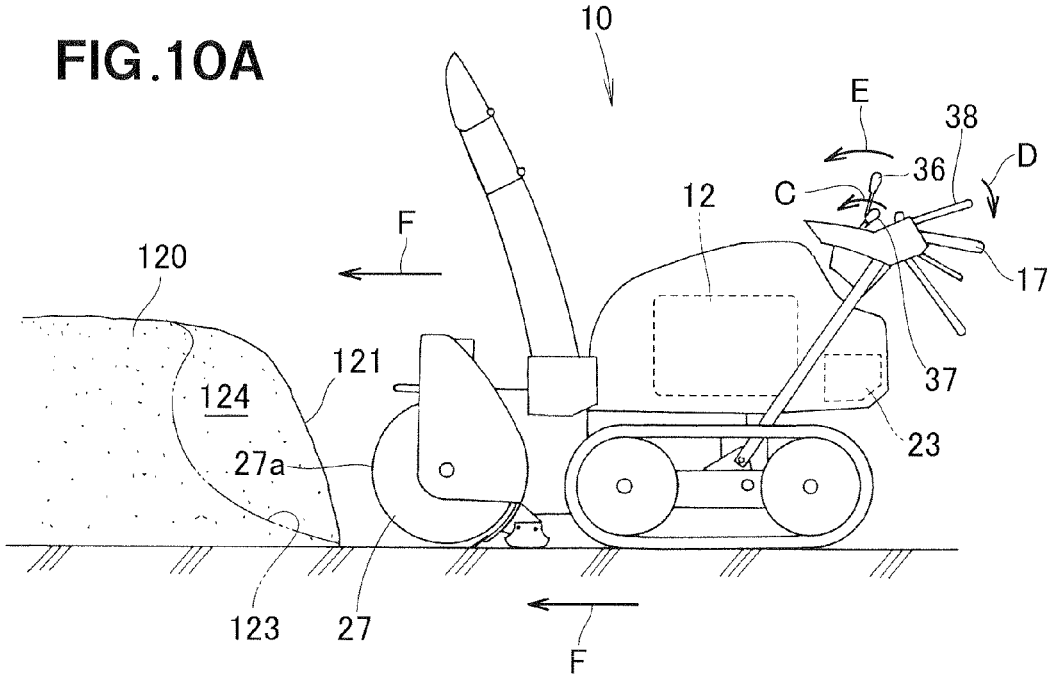
FIGS. 10A and 10B are views explanatory of an example manner in which snowing removing work is started by the first embodiment of the snow removing machine.

With reference to FIGS. 10-12, the following describe an example operational sequence executed by the control section 23 to perform snow removing work while appropriately controlling the height of the auger 27.

After the human operator depresses the main switch button 46 (FIG. 1) to turn on the main switch, he or she operates the throttle lever 37 as indicated by an arrow C to set a desired number of rotations of the engine 12. Then, the human operator turns on the operating clutch button 47 to place the operating clutch 33 in a connected state. By the operating clutch 33 being placed in the connected state like this, the auger 27 and the blower 28 are driven.

Then, the human operator pivots the travel preparation lever 38 close to the grips 17 as indicated by an arrow D to place a traveling clutch (not shown) in a connected state. Then, the human operator pivots the forward/rearward travel speed lever 36 to a forward travel position as indicated by an arrow E, to thereby cause the snow removing machine 10 to travel forward as indicated by an arrow F.

Figure 10B:
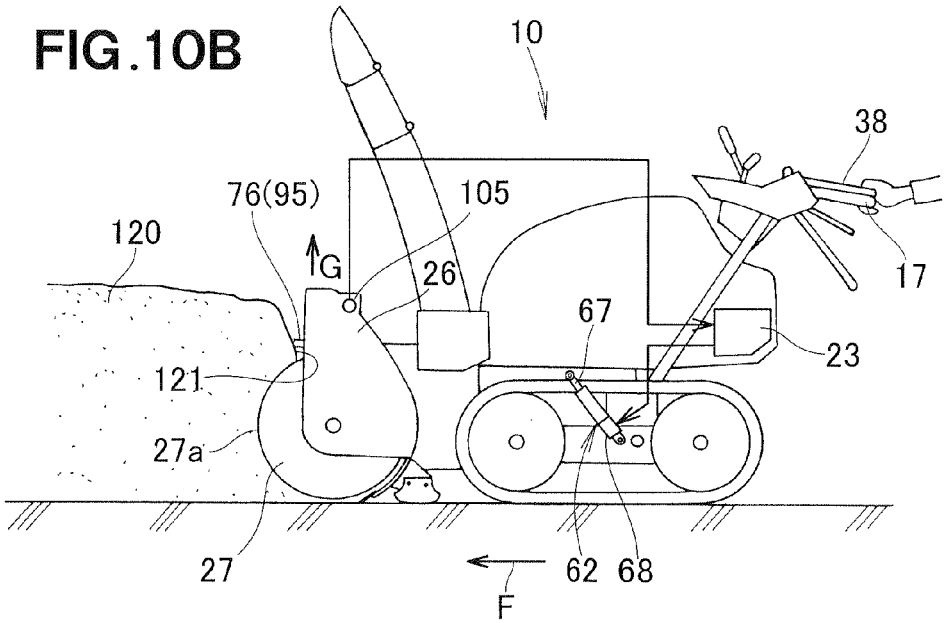

Then, as shown in FIG. 10B, the front end 27*a* of the auger 27 gets into (cuts into) a snow wall 121 of accumulated snow 120, so that the auger 27 starts removing the snow 120.

As the auger 27 (i.e., snow removing machine 10) travels forward, the snow-contacting bar 76 (more specifically, snow-contacting section 95) abuts against the snow wall 121.

As the snow-contacting section 95 abuts against snow wall 121, it is pressed rearward into the housing, so that the actuating shaft 106 (FIG. 3) of the accumulated snow height detecting sensor 105 is activated and thus accumulated snow height detection information is sent from the accumulated snow height detecting sensor 105 to the control section 23.

Then, on the basis of the accumulated snow height detection information sent from the accumulated snow height detecting sensor 105, an auger lifting signal is given from the control section 23 to the auger housing lifting and lowering mechanism 62. Thus, the lifting and lowering electric motor 68 of the auger housing lifting and lowering mechanism 62 is driven to expand the piston rod 67. In this manner, the auger 27 starts to be lifted as indicated by an arrow G.

Figure 11A:
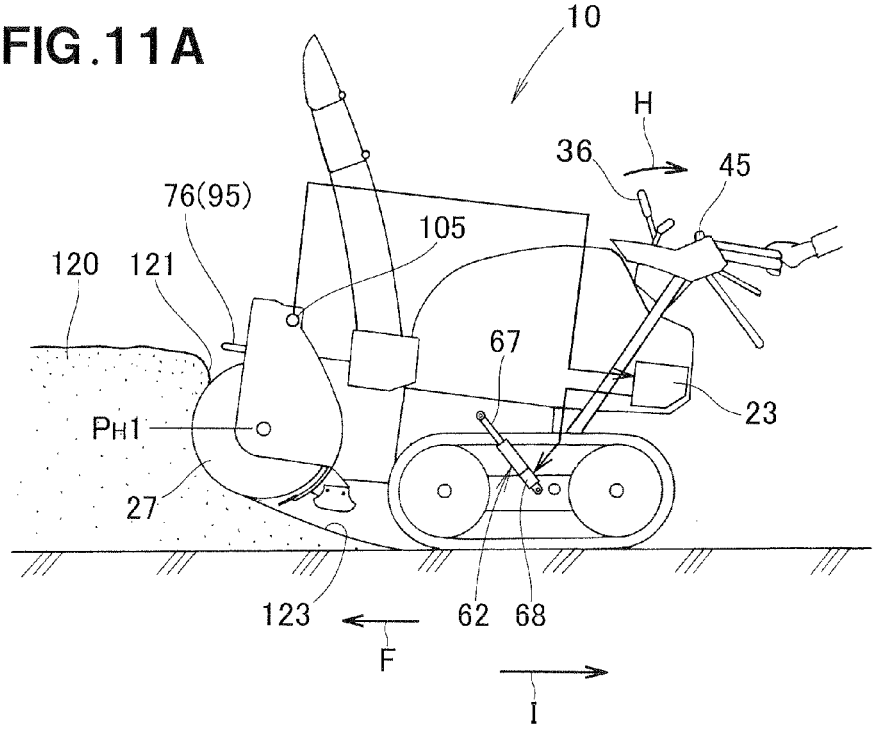
FIGS. 11A and 11B are views explanatory of an example manner in which the auger is lifted during the snowing removing work.

The snow removing machine 10 still continues to travel forward during the lifting of the auger 27. Thus, as shown in FIG. 11A, the auger 27 moves upward along an upwardly and forwardly slanting surface 123 of the accumulated snow 120 while removing the accumulated snow 120. In this way, accumulated snow 124 shown in FIG. 10A can be removed by the auger 27. As the axis of the auger 27 moving upward along the upwardly and forwardly slanting surface 123 reaches a height position $P_H$1, the snow-contacting section 95 of the snow-contacting bar 76 gets away from the snow wall 121.

Namely, once the accumulated snow height detecting sensor 105 detects a height of the accumulated snow 120, the control section 23 controls the lifting and lowering electric motor 68 to lift the auger 27. Thus, even when the accumulated snow height is above the auger 27, the instant embodiment can efficiently perform the removing work of the accumulated snow 120 by automatically lifting the auger 27 and thereby enhance the operability of the snow removing machine 10.

As the snow-contacting section 95 of the snow-contacting bar 76 gets away from the snow wall 121 as noted above, the snow-contacting bar 76 returns to its initial forwardly-projecting position (i.e., position where it was before abutting against the snow wall 121) by the biasing force of the springs 88 (FIG. 5).

By the snow-contacting bar 76 returning to the initial forwardly-projecting position as noted above, the actuating shaft 106 (FIG. 3) is activated so that no-accumulated-snow-detected information is sent from the accumulated snow height detecting sensor 105 to the control section 23.

Because the auger lifting and lowering lever 45 has been retained in its stopped position at this stage, an auger lifting/lowering cancellation signal is sent from the control section 23 to the auger housing lifting and lowering mechanism 62 on the basis of the no-accumulated-snow-detected information sent from the accumulated snow height detecting sensor 105. Then, the lifting and lowering electric motor 68 of the auger housing lifting and lowering mechanism 62 is deactivated, so that the piston rod 67 is retained in a stopped state. Thus, the auger 27 is retained at the height position $P_H$1. Then, the human operator can cause the snow removing machine 10 to travel rearward as indicated by an arrow I by moving the forward/rearward travel speed lever 36 to a rearward travel position as indicated by an arrow H.

Figure 11B:
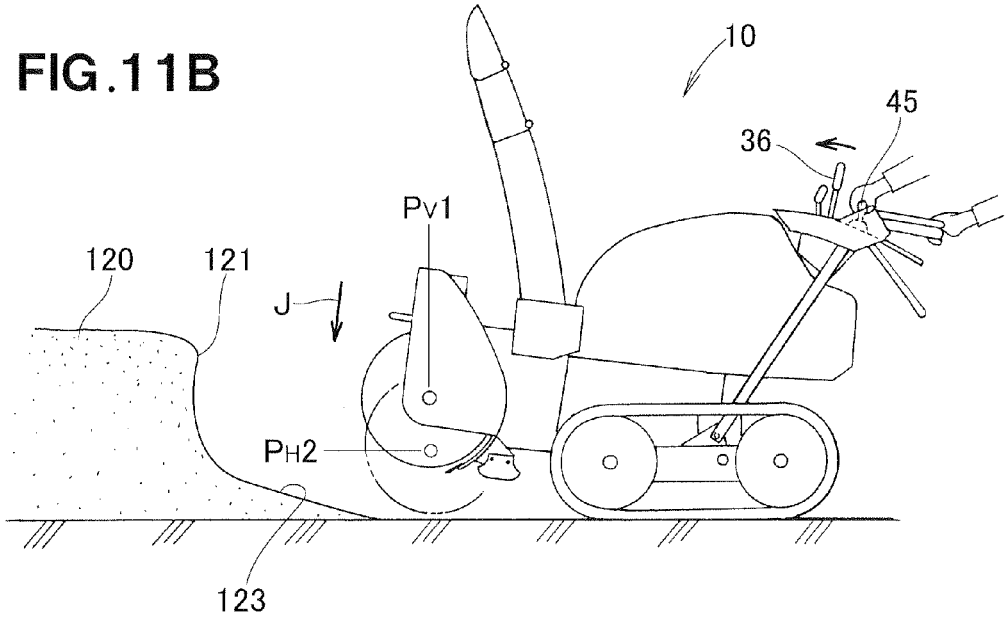
Figure 12A:
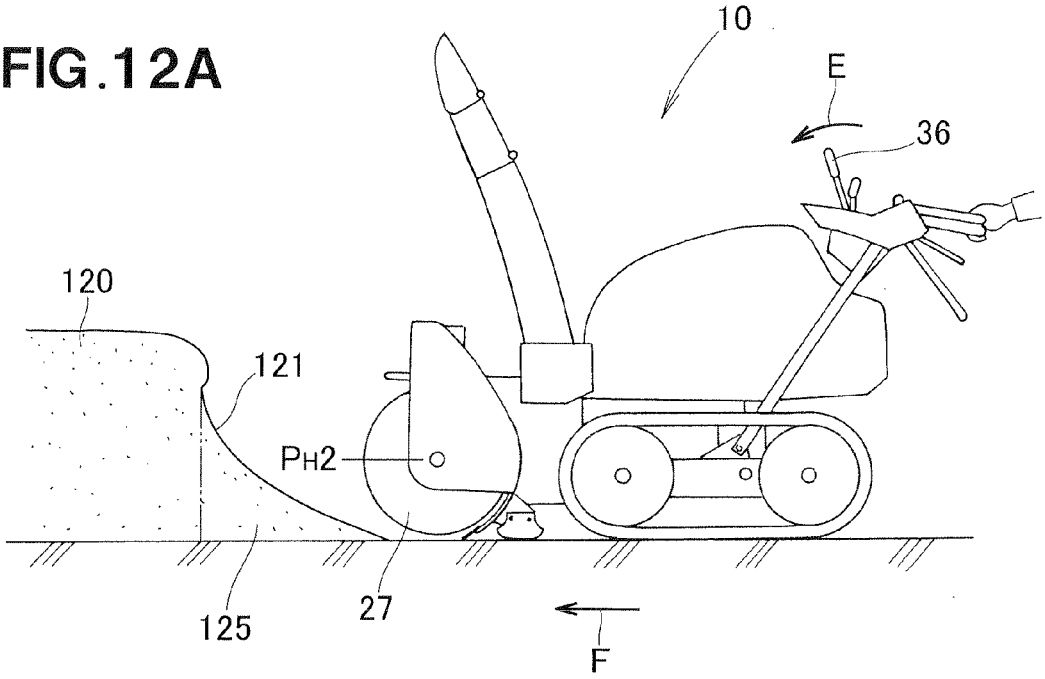
FIGS. 12A and 12B are views explanatory of an example manner in which the snowing removing work is caused to travel rearward away from accumulated snow and then proceed with the snowing removing work.

After the snow removing machine 10 returns to a position $P_V$1, the human operator operates the forward/rearward travel speed lever 36 to a neutral position to thereby stop the travel of the snow removing machine 10, as shown in FIG. 11B. Then, the human operator operates the auger lifting and lowering lever 45 to a lowering position to thereby lower the auger 27 to a position $P_H$2, as indicated by an arrow J After the auger 27 is lowered to the position $P_H$2, the human operator operates the forward/rearward travel speed lever 36 to a forward travel position as indicated by an arrow E, as shown in FIG. 12A. By the human operator operating the forward/rearward travel speed lever 36 to the forward travel position, the snow removing machine 10 is caused to travel forward as indicated by an arrow F. By such forward travel of the snow removing machine 10, the auger 27 can remove an upwardly-and-forwardly slanting, unremoved portion 125 of the accumulated snow which has been left unremoved in the last snow removing work.

Figure 12B:
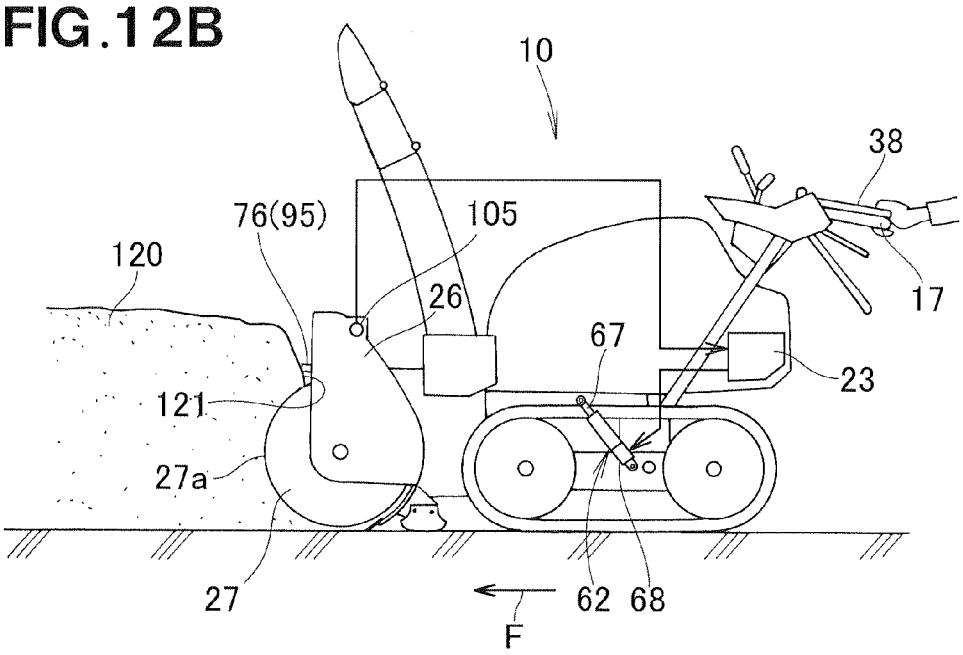

Namely, as the auger 27 (i.e., snow removing machine 10) travels forward, the snow-contacting bar 76 (more specifically, snow-contacting section 95) abuts against the snow wall 121, as shown in FIG. 12B, so that the snow-contacting section 95 is pressed rearward into the housing and thus the actuating shaft 106 (FIG. 3) of the accumulated snow height detecting sensor 105 is activated. Thus, accumulated snow height detection information is sent from the accumulated snow height detecting sensor 105 to the control section 23, in response to which the auger 27 moves upward along the upwardly and forwardly slanting surface 123 while removing the accumulated snow 120, in the same manner as described above in relation to FIG. 11A.

After that, the operations of FIGS. 10-12 are sequentially repeated, so that the snow removing machine 10 can sequentially remove, by means of the auger 127, the accumulated snow 120 from the snow wall 121 onward.

More specifically, the accumulated snow 124 (see FIG. 10A) is removed by first snow removing work, and the unremoved portion 125 (see FIG. 12A) is removed by second snow removing work; that is, the instant embodiment can perform so-called "obliquely cutting-off" snow removing work without troubling, i.e. involving an extra labor of, the human operator.

Second Embodiment

Next, a description will be given about a second embodiment of the snow removing machine 10 which is characterized by provision of a control section 130 in place of the control section 23 provided in the first embodiment. The control section 130 has functions for detecting a "lifting/lowering or stopped state of the auger 27", a "forward traveling or rearward traveling state of the snow removing machine 10", a "rotating or stopped state of the auger 27" and an "accumulated-snow-height detected or accumulated-snow-height undetected state".

Namely, the control section 130 determines whether the main switch button 46 is ON or OFF. Further, on the basis of "auger lifting/lowering information" output from the lifting and lowering lever detecting sensor operatively connected to the auger lifting and lowering lever 45, the control section 130 determines whether the auger 27 is currently being lifted or lowered through operation by the human operator or not currently being lifted or lowered (i.e., in a stopped state).

Further, on the basis of "forward/rearward travel information" output from the forward/rearward travel detecting sensor operatively connected to the forward/rearward travel speed lever 36, the control section 130 determines whether the snow removing machine 10 is currently traveling forward or traveling rearward.

Furthermore, on the basis of "clutch connection information" sent from an operating clutch detecting sensor operatively connected to the operating clutch button 47, the control section 130 determines whether the clutch is currently in a "connected state" (i.e. the auger 27 is currently in a rotating state) or currently in a "disconnected state" (i.e. the auger 27 is currently in a stopped state).

Also, when the auger lifting and lowering lever 45 is in the non-operated state, the control section 130 compares a value of "voltage (accumulated snow height information)" sent from the accumulated snow height detecting sensor 105 against a preset threshold value. If the value of the accumulated snow height information is greater than the threshold value, the control section 130 determines that the snow contacting section 95 has contacted accumulated snow.

If the control section 130 determines that the snow contacting section 95 has contacted accumulated snow (i.e. that an accumulated snow height in front of the auger 27 has been detected by the accumulated snow height detection section 22) as noted above, the control section 130 controls the auger lifting and lowering section 21 to lift the auger 27.

If the value of the accumulated snow height information is not greater than the threshold value, the control section 130 determines that the snow contacting section 95 has not yet contacted accumulated snow.

Figure 13:
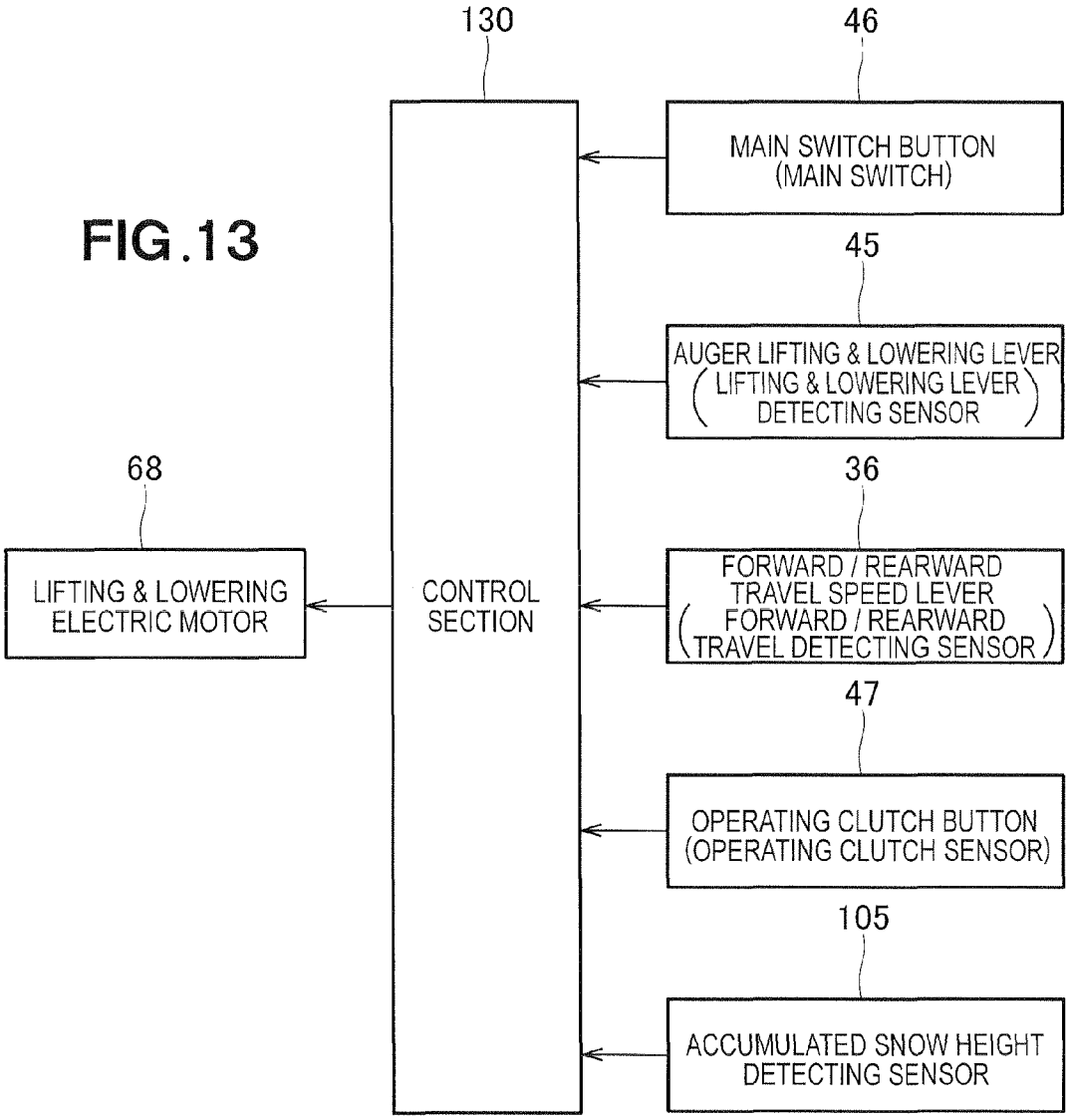
FIG. 13 is a functional block diagram showing a second embodiment of the snow removing machine.
Figure 14:
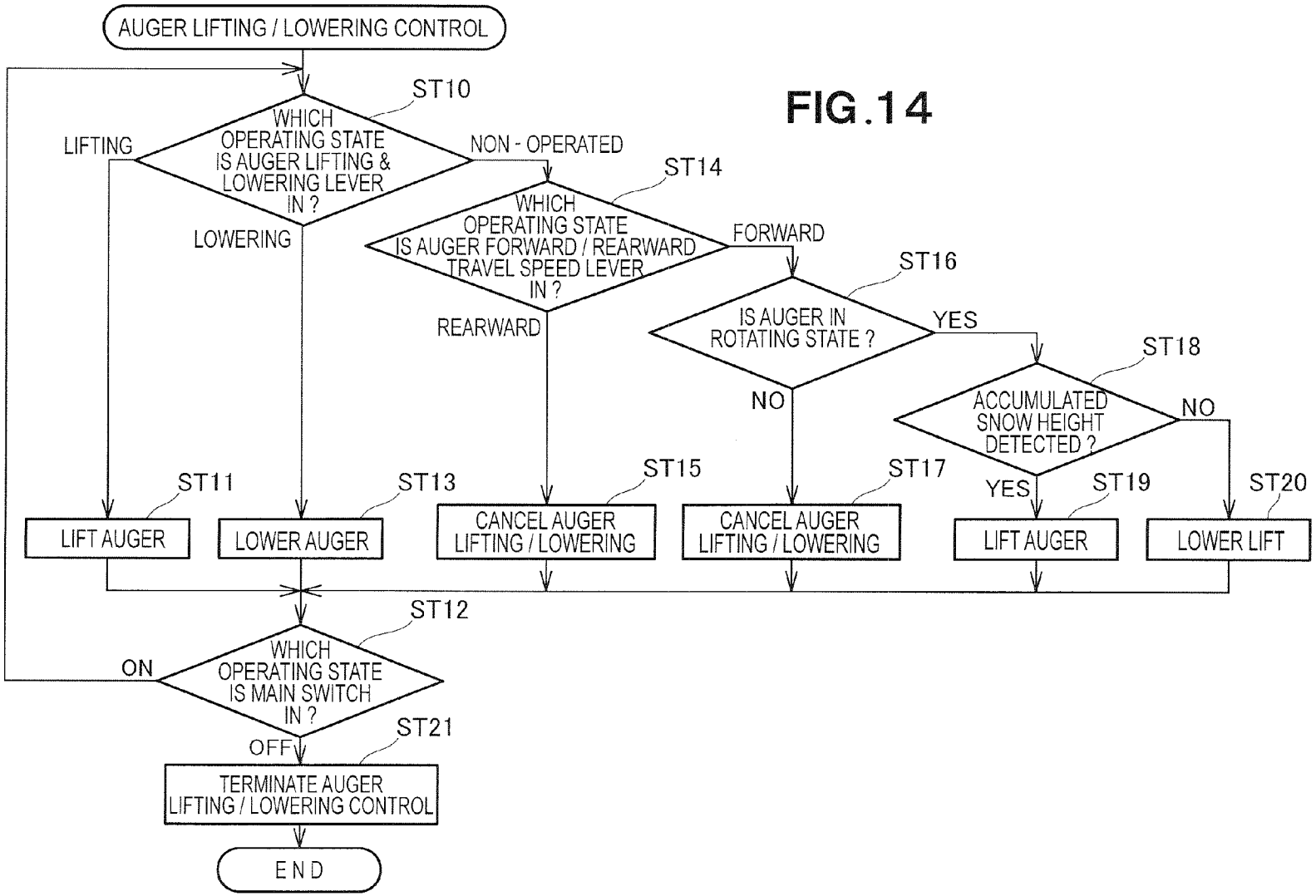
FIG. 14 is a flow chart showing an example operational sequence executed by a control section to lift and lower the auger in the second embodiment of the snow removing machine.

Next, a description will be given about an example operational sequence executed by the control section 130 to control the auger 27, with reference to a flow chart of FIG. 14 in conjunction with a functional block diagram of FIG. 13.

At step ST10, the control section 130 determines whether the auger lifting and lowering lever 45 is currently in the operated state (i.e., auger-lifting position or auger-lowering position), or in the non-operated state. Namely, on the basis of "auger lifting/lowering information" sent from the lifting and lowering lever detecting sensor operatively connected to the auger lifting and lowering lever 45, the control section 130 determines whether the auger lifting and lowering lever 45 is currently being operated by the human operator to lift or lower the auger 27 (i.e., in the operated state) or not currently being operated by the human operator to lift or lower the auger 27 (i.e., in the non-operated state).

If the auger lifting and lowering lever 45 is currently in the auger-lifting position as determined at step ST10, the control section 130 goes to step ST11 in order to continue the lifting of the auger 27. Then, if the main switch is currently ON as determined at step ST12, the control section 130 reverts to step ST10

If, on the other hand, the auger lifting and lowering lever 45 is currently in the auger-lowering position as determined at step ST10, the control section 130 goes to step ST13 in order to continue the lowering of the auger 27. Then, if the main switch is currently ON as determined at step ST12, the control section 130 reverts to step ST10.

If, on the other hand, the auger lifting and lowering lever 45 is currently in the non-operated state, the control section 130 branches to step ST14, where the control section 23 further determines whether the forward/rearward travel speed lever 36 is currently in the forward travel position or in the rearward travel position.

If the forward/rearward travel speed lever 36 is currently in the rearward travel position as determined at step ST14, the control section 130 proceeds to step ST15 to cancel lifting/lowering of the auger 27. If, after completion of step ST15, the main switch is ON as determined at step ST12, the control section 130 reverts to step ST10.

If, on the other hand, the forward/rearward travel speed lever 36 is currently in the forward travel position as determined at step ST14, the control section 130 continues to step ST16. At step ST16, the control section 130 determines, on the basis of information sent from the operating clutch sensor, whether the auger 27 is currently in the rotating state or in the non-rotating (or stopped) state. If the auger 27 is currently in the non-rotating state as determined at step S16, the control section 130 proceeds to step ST17 in order to cancel lifting/lowering of the auger 27. If, after completion of step ST17, the main switch is ON as determined at step ST12, the control section 130 reverts to step ST10.

If the auger 27 is currently in the rotating state as determined at step S16, the control section 130 proceeds to step ST18, where the control section 23 further determines, on the basis of the accumulated snow height detection information sent from the accumulated snow height detecting sensor 105, whether the value of the accumulated snow height information is greater than the threshold value. If the value of the accumulated snow height information is greater than the threshold value as determined at step ST18, the control section 130 goes to step ST19.

At step ST19, the control section 130 sends an auger lifting signal to the lifting and lowering electric motor 68 of the auger housing lifting and lowering mechanism 62, in response to which the lifting and lowering electric motor 68 is driven to rotate in the forward direction so that the piston rod 67 of the auger housing lifting and lowering mechanism 62 is expanded to lift the auger 27. If, after completion of step ST19, the main switch is ON as determined at step ST12, the control section 130 reverts to step ST10.

If the value of the accumulated snow height information is not greater than the threshold value as determined at step ST18, the control section 130 continues to step ST20. At step ST20, the CPU 130 sends an auger lowering signal to the lifting and lowering electric motor 68 of the auger housing lifting and lowering mechanism 62, in response to which the lifting and lowering electric motor 68 is driven to rotate in the reverse direction so that the piston rod 67 of the auger housing lifting and lowering mechanism 62 is contracted to lower the auger 27. If, after completion of step ST20, the main switch is ON as determined at step ST12, the control section 130 reverts to step ST10.

If, on the other hand, the main switch is OFF as determined at step ST12, the control section 130 reverts to step ST21. At step ST21, the lifting/lowering control of the auger 27 by the control section 130 is terminated.

Figure 15A:
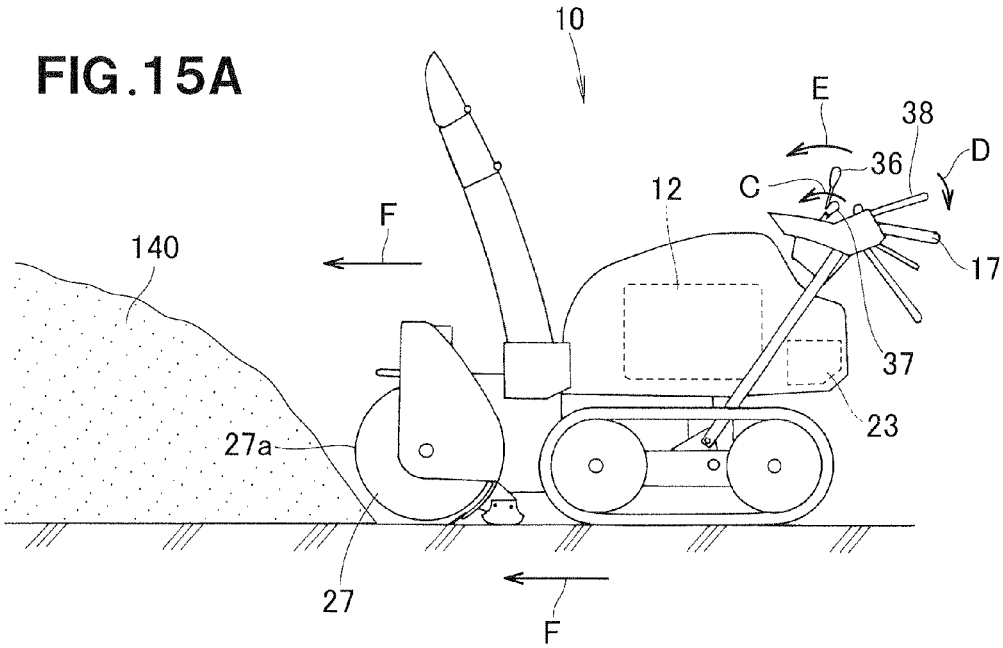
FIGS. 15A and 15B are views explanatory of an example manner in which snowing removing work is started by the second embodiment of the snow removing machine.
Figure 15B:
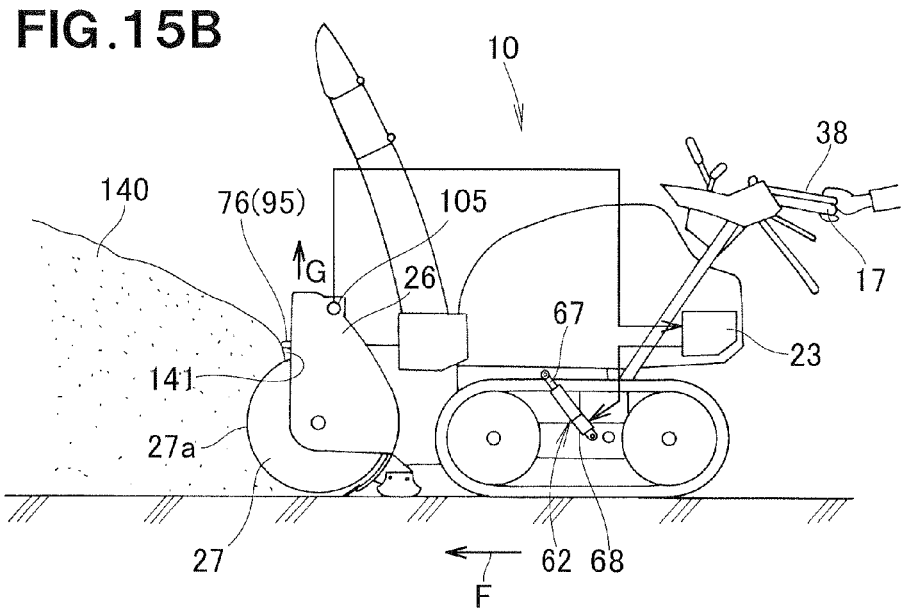
Figure 16A:
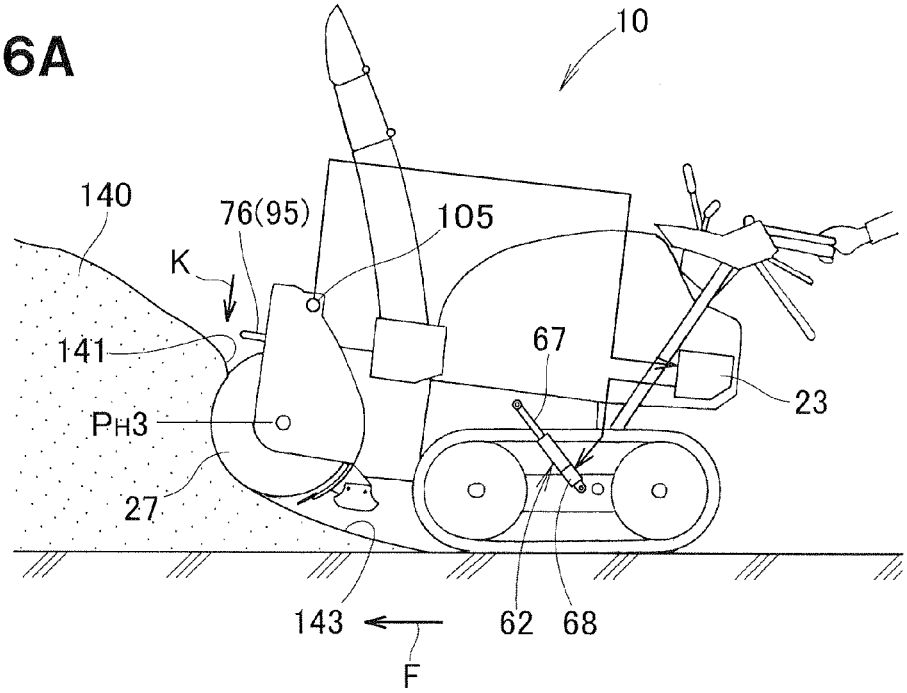
FIGS. 16A and 16B are views explanatory of an example manner in which the auger is lifted and lowered during the snowing removing work.
Figure 16B:
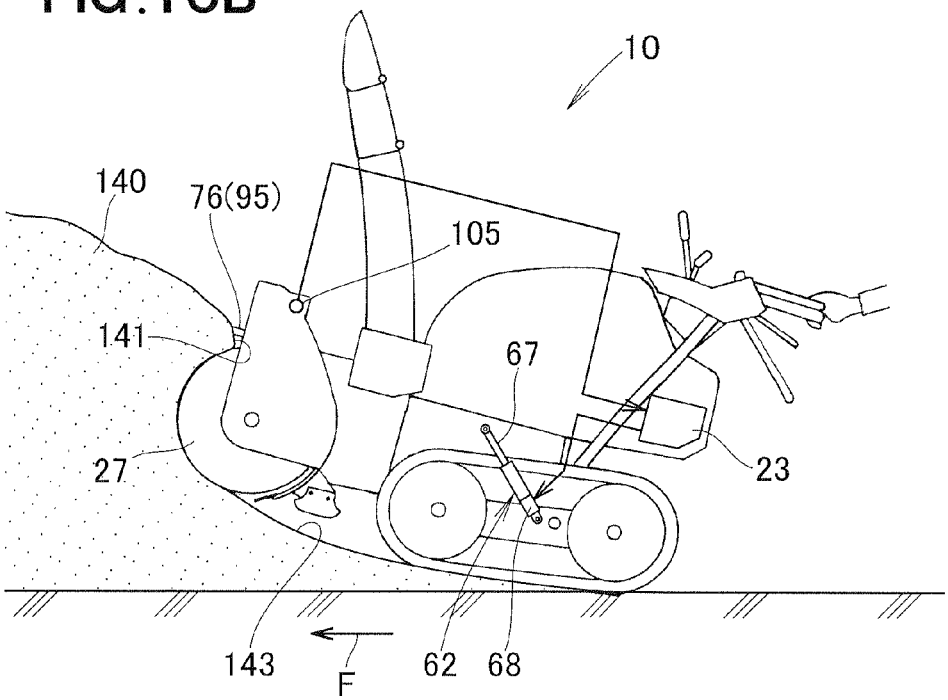
Figure 17A:
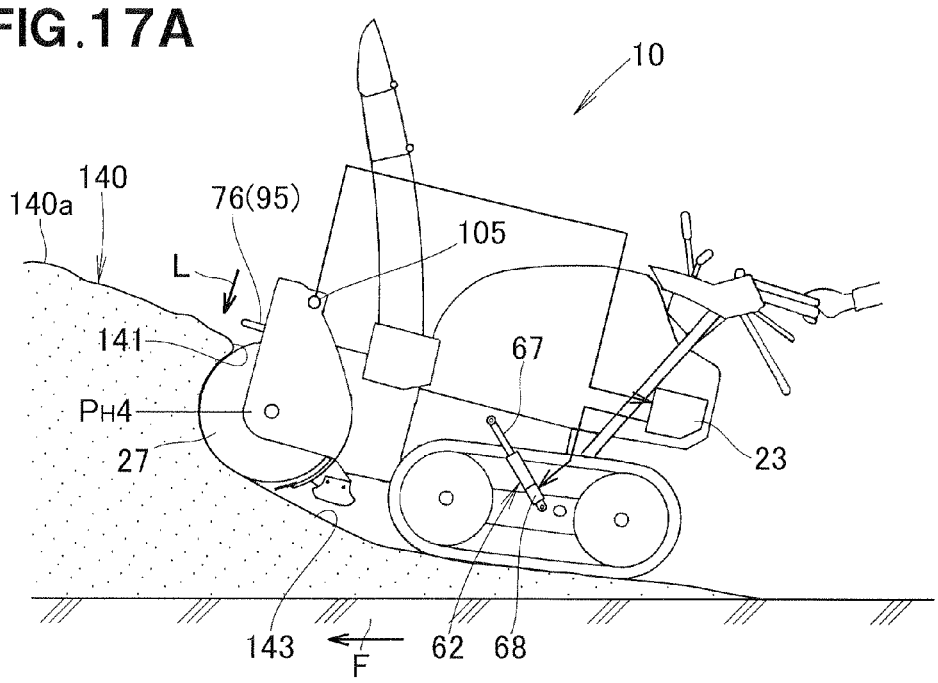
FIGS. 17A and 17B are views explanatory of an example manner in which the second embodiment of the snow removing machine removes accumulated snow along the surface of the accumulated snow.
Figure 17B:
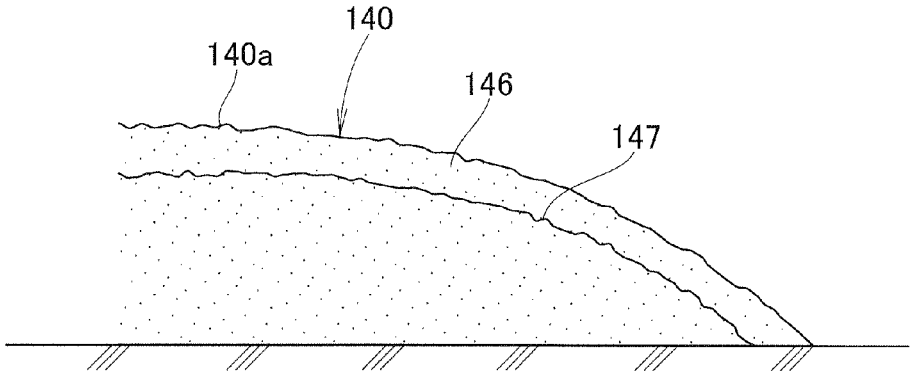

With reference to FIGS. 15-17, the following describe an example operational sequence executed by the control section 130 to perform snow removing work while appropriately controlling the height of the auger 27.

After the human operator depresses the main switch button 46 (FIG. 1) to turn on the main switch, he or she operates the throttle lever 37 as indicated by an arrow C to set a desired number of rotations of the engine 12, as shown in FIG. 15A. Then, the human operator turns on the operating clutch button 47 of FIG. 1 to place the operating clutch 33 in the connected state. By the operating clutch 33 being placed in the connected state like this, the auger 27 and the blower 28 are driven.

Then, "clutch connection information" (indicating that the auger 27 is in the rotating state) output from the operating clutch detecting sensor operatively connected to the operating clutch button 47 is sent to the control section 130.

Then, the human operator pivots the travel preparation lever 38 close to the grips 17 as indicated by an arrow D to place the traveling clutch (not shown) in a connected state. Then, the human operator pivots the forward/rearward travel speed lever 36 to a forward travel position as indicated by an arrow E, to thereby cause the snow removing machine 10 to travel forward as indicated by an arrow F.

By the forward/rearward travel speed lever 36 pivoting to the forward travel position, "forward travel information" is output from a forward/rearward travel detecting sensor operatively connected to the forward/rearward travel speed lever 36 and sent to the control section 130.

Then, as shown in FIG. 15B, the front end 27*a* of the auger 27 gets into (cuts into) a snow wall 141 of accumulated snow 140, so that the auger 27 starts removing the snow 140.

As the auger 27 (i.e., snow removing machine 10) travels forward, the snow-contacting bar 76 (more specifically, snow-contacting section 95) abuts against the snow wall 141.

As the snow-contacting section 95 abuts against snow wall 141, it is pressed rearward into the housing, so that the actuating shaft 106 (FIG. 3) of the accumulated snow height detecting sensor 105 is activated and thus accumulated snow height detection information is sent from the accumulated snow height detecting sensor 105 to the control section 130.

Then, on the basis of the accumulated snow height detection information sent from the accumulated snow height detecting sensor 105, an auger lifting signal is given from the control section 130 to the auger housing lifting and lowering mechanism 62. Thus, the lifting and lowering electric motor 68 of the auger housing lifting and lowering mechanism 62 is driven to expand the piston rod 67. In this manner, the auger 27 starts to be lifted as indicated by an arrow G.

The snow removing machine 10 still continues to travel forward during the lifting of the auger 27. Thus, as shown in FIG. 16A, the auger 27 moves upward along an upwardly and forwardly slanting surface 143 of the accumulated snow 140 while removing the accumulated snow 140. As the axis of the auger 27 moving upward along the upwardly and forwardly slanting surface 143 reaches a height position $P_H$3, the snow-contacting section 95 of the snow-contacting bar 76 gets away from the snow wall 141.

As the snow-contacting section 95 of the snow-contacting bar 76 gets away from the snow wall 141 as noted above, the snow-contacting bar 76 returns to its initial forwardly-projecting position (i.e., position where it was before abutting against the snow wall 141) by the biasing force of the springs 88 (FIG. 5).

By the snow-contacting bar 76 returning to the initial forwardly-projecting position, the actuating shaft 106 (FIG. 3) is activated so that no-accumulated-snow-detected information is sent from the accumulated snow height detecting sensor 105 to the control section 130.

Because the auger lifting and lowering lever 45 has been retained in its stopped position at this stage, a lowering signal is sent from the control section 130 to the auger housing lifting and lowering mechanism 62 on the basis of the no-accumulated-snow-detected information output from the accumulated snow height detecting sensor 105. Thus, the auger 27 is lowered from the height position $P_H$3, as indicated by an arrow K.

Namely, as the snow removing machine 10 travels forward as indicated by an arrow F while lowering the auger 27, the snow contacting section 95 of the bar 76 abuts against the snow wall 141.

As the snow-contacting section 95 abuts against snow wall 141, it is pressed rearward into the housing, so that the actuating shaft 106 (FIG. 3) of the accumulated snow height detecting sensor 105 is activated and thus accumulated snow height detection information is sent from the accumulated snow height detecting sensor 105 to the control section 23. Thus, the auger 27 moves upward along the upwardly and forwardly slanting surface 143 while removing the accumulated snow 140, as described above in relation to FIG. 16A.

As the axis of the auger 27 moving upward along the upwardly and forwardly slanting surface 143 reaches a height position $P_H$4, the snow-contacting section 95 of the snow-contacting bar 76 gets away from the snow wall 141, as shown in FIG. 17A.

As the snow-contacting section 95 of the snow-contacting bar 76 gets away from the snow wall 141, the auger 27 descends from the height position $P_H$4 as indicated by an arrow L, as described above in relation to FIG. 16A.

By the aforementioned operations of FIGS. 15-17 being sequentially repeated, the auger 27 can be moved along the surface 140*a* of the accumulated snow 140, so that accumulated snow 146 lying along the surface 140*a* of the accumulated snow 140 can be removed by the auger 27. By performing snow removing along the surface 140*a* of the accumulated snow 140, the instant embodiment can achieve an even further enhanced operability.

It should be appreciated that the snow removing machine 10 of the present invention is not limited to the above-described embodiments and may be modified as necessary as exemplified below.

Whereas the first and second embodiments have been described above in relation to the case where the control section 23 or 130 lifts the auger 27 in response to the accumulated snow height detection section 22 detecting accumulated snow, the present invention is not so limited. Alternatively, the human operator may manually lift the auger 27 by operating the auger lifting and lowering lever 45 in response to the accumulated snow height detection section 22 detecting accumulated snow.

Further, whereas the first and second embodiments have been described above in relation to the case where the snow-contacting section 95 of the snow-contacting bar 76 is located in the horizontal area E1 between the front end 27*a* of the auger 27 and the front end 26*c* of the housing 26 and in the vertical area E2 between the upper end 27*b* of the auger 27 and the upper end 26*d* of the housing 26, the present invention is not so limited. For example, the snow-contacting section 95 may be located forwardly of the front end 27*a* of the auger 27 and upwardly of the upper end 26*d* of the housing 26.

Furthermore, whereas the first embodiment has been described above in relation to the case where the lifting and lowering electric motor 68 is deactivated on the basis of the accumulated snow height detection information when the lifting of the auger 27 is to be stopped or canceled, the lifting of the auger 27 may be stopped or canceled in any other suitable manner than the aforementioned. For example, the lifting of the auger 27 may be stopped or canceled by the piston rod 67 of the auger housing lifting and lowering mechanism 62 being expanded to the upper end of the stroke (i.e., stroke end) of the cylinder, or manually by the human operator operating the auger lifting and lowering lever 45.

Furthermore, whereas the first and second embodiments have been described above as having the control sections 23 and 130, respectively, only a single control section may be provided which has the functions of the two embodiments. In such a case, the human operator may switch between the functions of the first embodiment and the second embodiment via a mode change switch in accordance with a condition of snow removing work.

Furthermore, the constructions, shapes, etc. of the auger lifting and lowering section 21, accumulated snow height detection section 22, auger 27, etc. are not limited to the aforementioned and may be modified as necessary.

The basic principles of the present invention are well suited for application to snow removing machines which include an auger for removing snow and an auger lifting and lowering section for moving the auger in an up-down direction.

What is claimed is:

1. A snow removing machine comprising:

a frame;

an accumulated snow height detection section having a housing and being mounted to the frame;

an auger for removing accumulated snow, the auger being provided within the housing;

accumulated snow height detection means for detecting an accumulated snow height in front of the auger, the accumulated snow height detection means being affixed to the housing;

auger lifting and lowering means for lifting and lowering the auger; and a control section for controlling the auger lifting and lowering means to lift the auger when an accumulated snow height has been detected by the accumulated snow height detection means.

2. The snow removing machine according to claim 1, wherein the accumulated snow height detection means is operationally connected to a snow contacting bar extending above the auger.

3. The snow removing machine of claim 1, wherein, when no accumulated snow height has been detected by the accumulated snow height detection means, the control section controls the auger lifting and lowering means to lower the auger.

4. The snow removing machine according to claim 1, wherein the housing is provided in front of the frame.

5. A snow removing machine comprising:

a frame;

an accumulated snow height detection section having a housing and being mounted to the frame;

an auger for removing accumulated snow, the auger being provided within the housing; and accumulated snow height detection means for detecting an accumulated snow height in front of the auger, the accumulated snow height detection means being affixed to an inner surface of the housing.

* * * * *